US006087051A

United States Patent [19]

Shoji et al.

[11] Patent Number: 6,087,051

[45] Date of Patent: Jul. 11, 2000

[54] INFORMATION RECORDING MATERIAL

[75] Inventors: Takehiko Shoji; Yoshihiko Suda; Noriyuki Kokeguchi; Shin-ichi Suzuki, all of Hino, Japan

[73] Assignee: Konica Corporation, Japan

[21] Appl. No.: 08/889,520

[22] Filed: Jul. 8, 1997

[30] Foreign Application Priority Data

| | | | |
|---|---|---|---|
| Jul. 12, 1996 | [JP] | Japan | 8-183448 |
| Jul. 24, 1996 | [JP] | Japan | 8-194680 |
| Jul. 25, 1996 | [JP] | Japan | 8-196436 |
| Jul. 26, 1996 | [JP] | Japan | 8-197502 |
| Oct. 17, 1996 | [JP] | Japan | 8-274644 |
| Jan. 13, 1997 | [JP] | Japan | 9-003738 |

[51] Int. Cl.[7] ..... G03C 1/76; B41M 5/00

[52] U.S. Cl. ..... 430/14; 430/18; 430/531; 430/533; 430/961; 428/423.1; 347/105

[58] Field of Search ..... 430/14, 18, 531, 430/533, 536, 961; 347/105, 106; 428/195, 205, 423.1

[56] References Cited

U.S. PATENT DOCUMENTS

| | | | |
|---|---|---|---|
| 5,376,434 | 12/1994 | Ogawa et al. | 428/195 |
| 5,679,505 | 10/1997 | Tingler et al. | 430/523 |

FOREIGN PATENT DOCUMENTS 63-303791 12/1988 Japan .

*Primary Examiner*—John A. McPherson
*Attorney, Agent, or Firm*—Jordan B. Bierman; Bierman, Muserlian and Lucas

[57] ABSTRACT

An information recording material having thereon an image carrier layer composed of a hydrophilic polymer and a protective covering layer. The protective covering layer contains an aqueous polyurethane resin or an aqueous polyacryl resin. An information recording material which is excellent in terms of water resistance, anti-scratch property, glossiness, image storage stability and resistance to fingerprints is obtained.

5 Claims, 7 Drawing Sheets

FIG. 3 ( A )
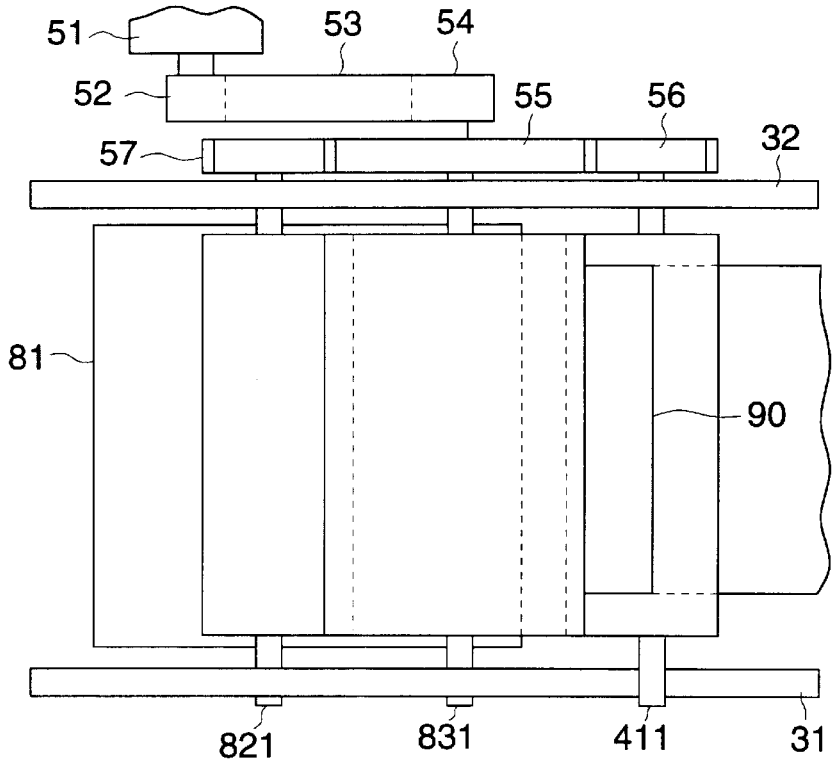
FIG. 3 ( B )
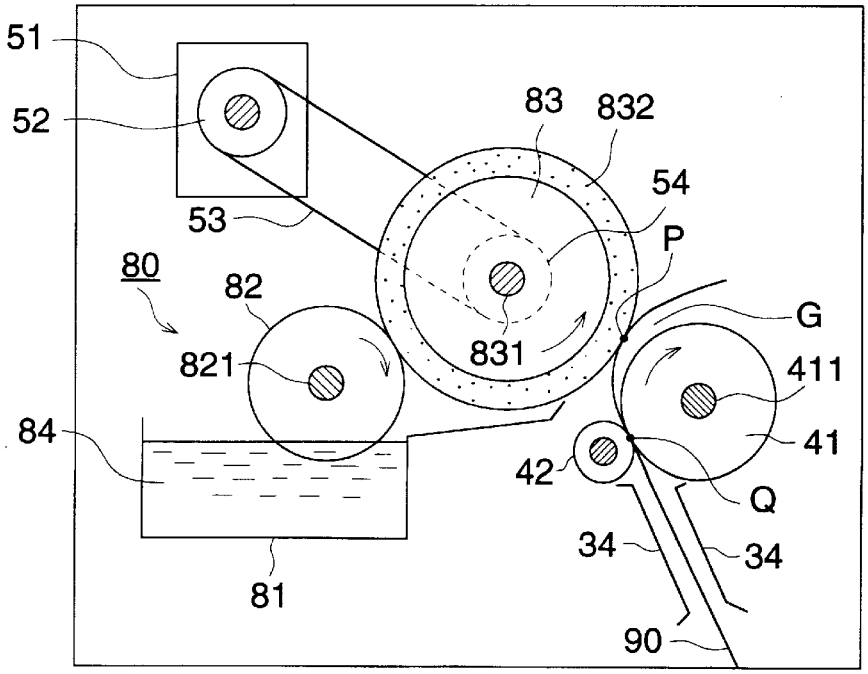

FIG. 5 ( A )
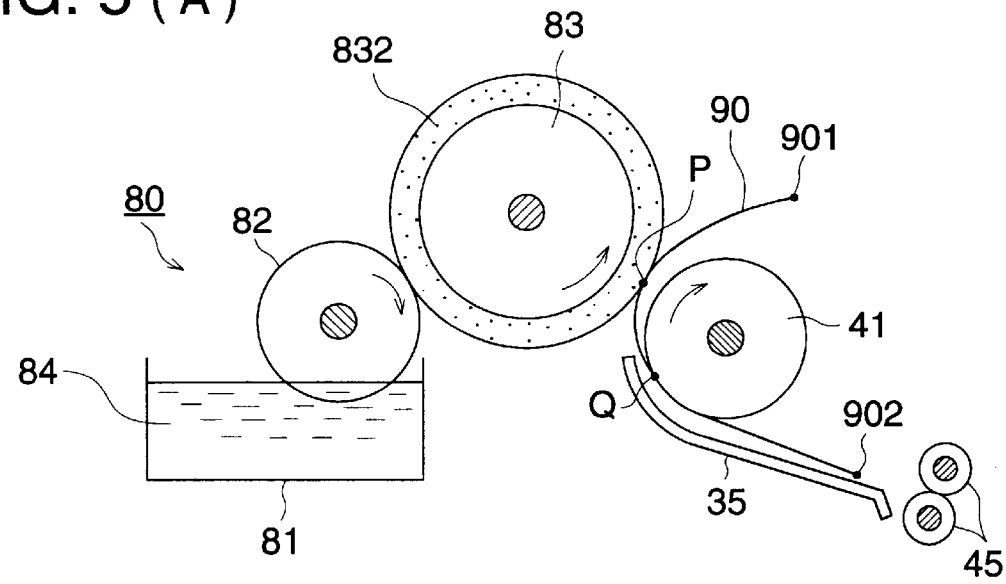
FIG. 5 ( B )
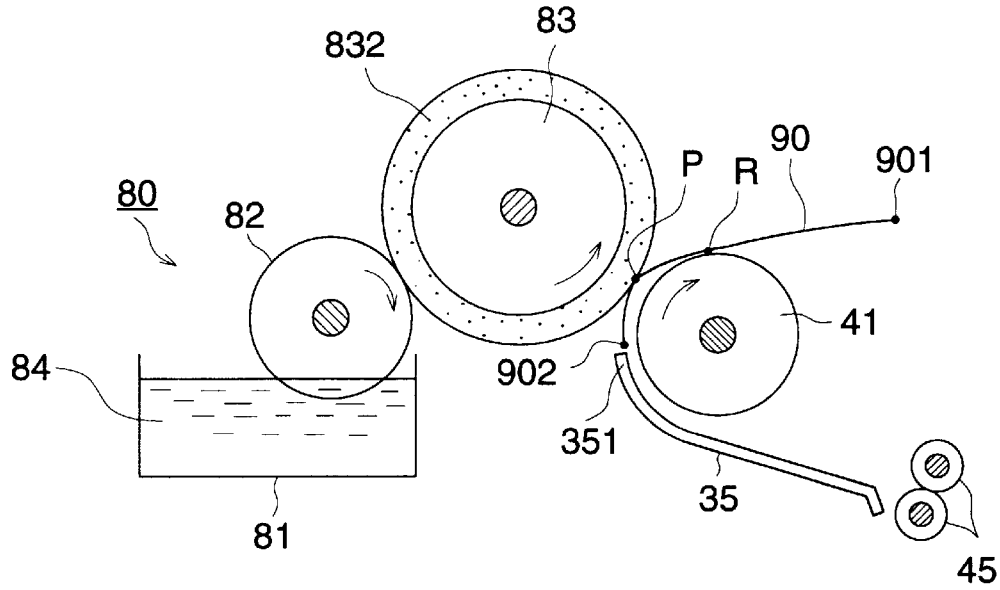

INFORMATION RECORDING MATERIAL

The present invention relates to an information-recording material having a protective covering layer. More particularly, the present invention relates to an information-recording material having a protective covering layer and comprising a support provided thereon with an image carrier layer composed of at least one hydrophilic polymer. Specifically, the present invention relates to an ink jet printer printing medium and a photographic print which are excellent in terms of water resisting property, fingerprint sticking prevention property, improvement in ease of fingerprint removal, transparency and image storage stability and which have a protective covering layer with no sense of deteriorated image quality.

BACKGROUND OF THE INVENTION

Generally, ink jet printer-printed materials, a thermo-transfer materials or information-recording materials having an image carrier layer composed of a hydrophilic polymer such as a silver halide light-sensitive material are poor in moisture resistance. They easily spot at the slightest touch of drops of moisture. In addition, fingerprints show readily and sticking is also a problem.

Due to the above, heretofore, a protective layer was often provided on image recording surfaces. For preparing such a protective layer, technologies of coating a radiographic hardening resin and hardening it with radiographic radiation are disclosed in Japanese Patent Publication Open to Public Inspection (hereinafter, referred to as Japanese Patent O.P.I. Publication) Nos. 57023/1978, 201248/1986 and 21150/1987. However, the above-mentioned technologies have the following shortcomings: namely, the above-mentioned layers exhibited insufficient adhesion with the image carrier layer. There were also problems in terms of toxicity to exposed skin. It was difficult to counter these shortcoming. An apparatus to irradiate with radiographic rays was necessary. In addition, there were many other shortcomings including cost, safety and complexity.

In addition, technologies to laminate an information-recording material having an image carrier layer are disc losed in Japanese Patent O.P.I. Publication Nos. 62360/1987 and 259570/1988. However, these methods are so expensive that they are not employed in ordinary inexpensive printing material and printing photography, except for special applications.

In addition, technologies to form a protective covering layer of the information-recording material by means of resin latex are disclosed in Japanese Patent O.P.I. Publication Nos. 247370/1987 and 110169/1994. Further, a technology to obtain the protective covering layer by means of an ionic polyester is disclosed in 212640/1991. These technologies improved water resisting property only slightly. In addition, scratch resistance deteriorated. Therefore, they were hard to be accepted by the market.

In addition, it is commonly known that polyurethane is used for photographic recording materials and that aforesaid polyurethane is used in conjunction with gelatin, a hydrophilic colloid. For example, Japanese Patent Publication No. 36365/1975, Japanese Patent O.P.I. Publication Nos. 67841/1981, 145556/1986 and 56651/1987, British Patent Nos. 1345741 and 2063500, European Patent No. 185248, West German Patent No. 1472746 and U.S. Pat. No. 3,607,289 disclose technologies to utilize ionic polyurethane for improvement in terms of fragility of the gelatin layer and for improved sensitivity. However, most of the anionic polyurethanes disclosed in the above-mentioned patents have structures in which sulfonic acid or its salt or phosphoric acid or its salt is introduced to a terminal group. In addition, with regard to its form, aforesaid polyurethane is mixed with gelatin, which is a hydrophilic colloid, to form a binder. Therefore, the above-mentioned polyurethanes are not used in protective covering layers.

SUMMARY OF THE INVENTION

An object of the present invention is to provide an information recording material having high added values which is excellent in terms of water resistance, anti-scratch property, glossiness, image storage stability and resistance to fingerprints, is easy to remove contamination and, even when said material is folded as in a two-page spread type, its facing pages do not stick to each other is simple and low in cost.

The information recording material of the invention is disclosed.

An information recording material of the invention comprises an image carrier layer composed of at least one hydrophilic polymer, and a protective covering layer on a support. The protective covering layer contains an aqueous polyurethane resin or an aqueous polyacryl resin.

In one of the embodiment of the invention, the aqueous polyurethane resin or an aqueous polyacryl resin in the protective covering layer is a thermal reactive aqueous polyurethane resin or a thermoplastic aqueous polyurethane resin, respectively The aqueous polyurethane resin comprises preferably polycarbonate ester represented by the following Formula (I) as a monomer unit:

Formula (I)

$$-\!\!\left(O-R-O-CO\right)\!\!-$$

wherein R represents a divalent combination group.

The aqueous polyurethane resin comprises preferably an aliphatic isocyanate group and a carboxyl group in a monomer unit.

The protective covering layer preferably contains a thermal reactive aqueous polyacryl resin or a thermoplastic aqueous polyacryl resin.

BRIEF EXPLANATION OF DRAWINGS

FIG. 3(A) and FIG. 3(B) illustrate a schematic drawing of a sheet material coating apparatus.

FIG. 5(A) and FIG. 1(B) illustrate still another schematic drawing of a sheet material coating apparatus.

EXPLANATION OF NUMERAL

10. Color photographic printer

10A. Printer section

Figure 1:
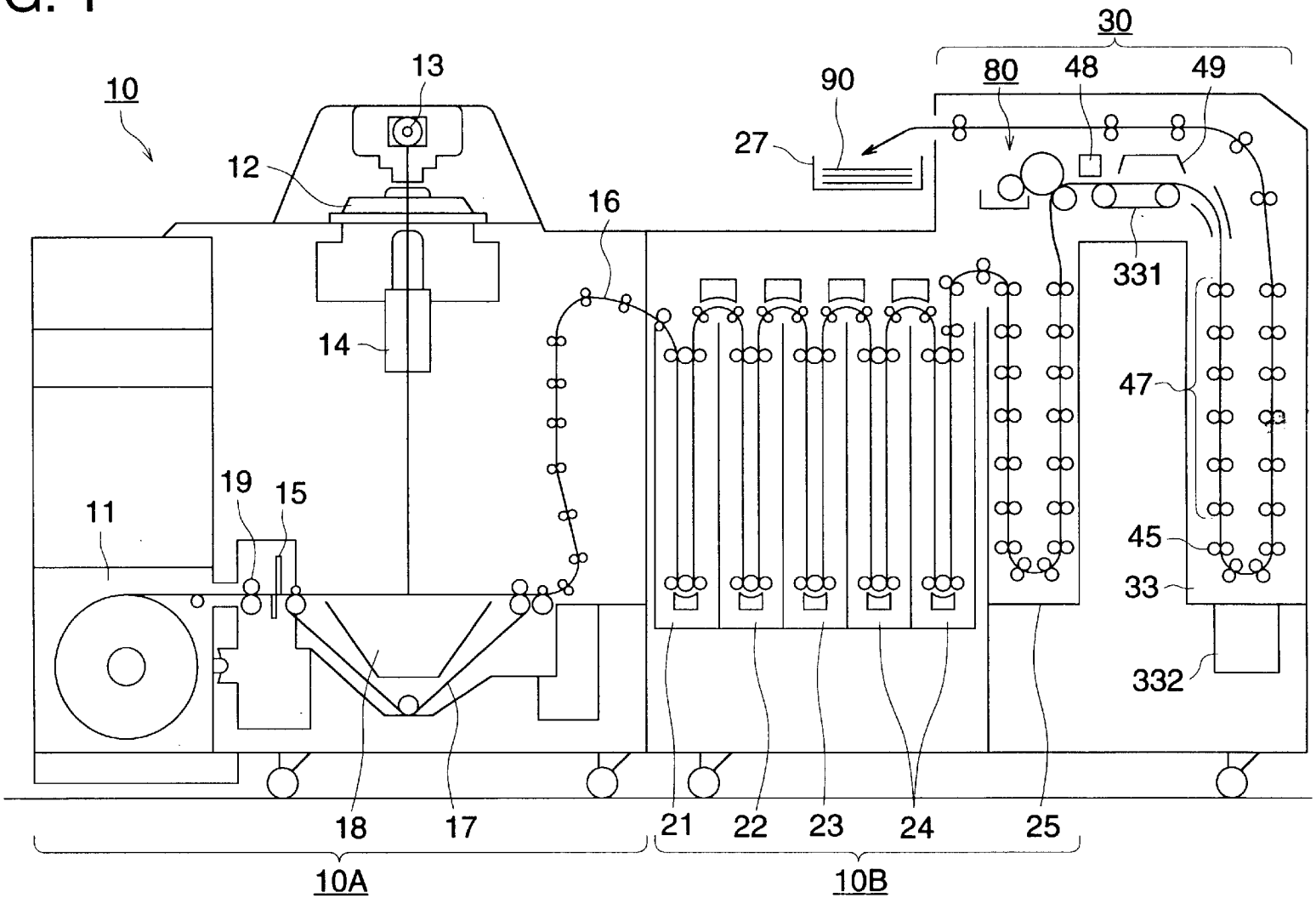
FIG. 1 illustrates a drawing of a color photographic printer in which a sheet material coating apparatus is integral.

10B. Development section
26 and 27. Tray
30. Sheet material coating apparatus
33. Drier chamber
331. Belt drier section
34 and 35. Guide
41. Back roll (roll)
42, 43, 44 and 45 Roll
80. Coating means
81. Container for coating solution
82. Roll
83. Coating roll (roll)
84. Coating solution
90 Sheet material (color paper)
901. The leading edge
902. The trailing edge
P. Contact point (coating position)
Q. Contact point
R. Contact point
G. Gap

DETAILED DESCRIPTION OF THE INVENTION

Hereinafter, the present invention will be explained.

A polyurethane or polyacryl resin dissolved in an organic solvent is widely applied as a useful material as an adhesive, coating paint or resin modifier. When a resin synthesized using solvents was used for a protective covering layer of the information-recording material comprising an image carrier layer composed of hydrophilic polymers, unacceptable defects such as loss of image information and perceptible deterioration of image storage stability were noted in spite of its excellent water resistance properties.

There was another problem. Namely, the solvents used for synthesizing splashed into the air so that environment and operators were contaminated. Therefore, in place of conventional solvent-type polyurethane or polyacryl resins employing organic solvents, water-soluble type or water-dispersed emulsion type polyurethane or polyacryl resins are being developed in the field of adhesive agents and paints are being considered. It is being studied to see whether such types may be employed for the information-recording material.

In the present invention, "hydrophilic polyurethane resin" is defined to include water-soluble polyurethanes and water-dispersed-emulsion polyurethanes. "Hydrophilic" refers to a macroscopically uniform composition such as an aqueous solution, an emulsified product or a soluble material.

In the present invention, "polyurethane resin" is a general name of polymers having urethane bonds numerously in a molecule. The polyurethane resins are polymers including urethane bonds obtained by poly-addition reaction between polyisocyanate and polyol utilizing reactivity of an isocyanate group on an active hydrogen compound, urea bonds, bonds deriving from the reaction between an isocyanate group and an active hydrogen such as a biuretallophanate bond, ester bonds contained in an active hydrogen compound molecule, ether bonds, amide bonds and uretodione, isocyanulate and carbodiimide which are produced due to reaction between isocyanates, and polymers having strong polarity and also having a large molecule coagulation force.

Generally, polyurethane resins have excellent performances in terms of mechanical properties, abrasion-durability properties, storage stability and chemical resistance durability due to secondary bondage due to urethane bond and urea bond which exist inside the molecules and which have noticeably large coagulation energy value. In addition, by controlling the kind of raw materials used such as polyisocyanate and active hydrogen compounds, composition ratio and reaction conditions.

The polyurethane resins of the present invention are polymers containing a urethane bond in a polyurethane-resin-constituting monomer unit. Preferably, they include at least one polycarbonate ester in a polyurethane-resin-constituting monomer unit. More preferably, they are characterized to contain at least one aliphatic acid polyisocyanate residual group and a carboxyl group in the polyurethane-resin-constituting monomer unit.

As a polyisocyanate used for synthesizing the polyurethane resins of the present invention, the following compounds are cited. However, the present invention is not limited thereto: toluenediisocyanate, diphenylmethanediisocyanate, 1,6-hexamethylenediisocyanate, 2,2,4(2,4,4)-trimethylhexamethylenediisocyanate, p-phenylenediisocyanate, 4,4'-dicychlohexylmethanediisocyanate, 3,3'-dimethyldiphenyl, 4,4'-diisocyanate, dianisidinediisocyanate, m-xylenediisocyanate, 1,3-bis(isocyanatemethyl) cyclohexane, tetramethylxylenediisocyanate, isohorondiisocyanate, 1,5-naphthalenediisocyanate, 1,4-cyclohexyldiisocyanate, lysinediisocyanate, dimethyltriphenylmethanetetraisocyanate, triphenylmethanetriisocyanate, tris(isocyanatephenyl) thiophosphate, urethane-denatured toluenediisocyanate, alophanate-denatured toluenediisocyanate, buret-denatured toluenediisocyanate, isocyanulate-denatured toluene diisocyanate, urethane-denatured diphenylmethanediisocyanate, carbodiimide-denatured diphenylmethanediisocyanate, uretonimine-denatured diphenylmethanediisocyanate, acylurea-denatured diphenylmethanediisocyanate and polymeric diphenylmethanediisocyanate.

The above-mentioned isocyante compounds may be used singly. Or, they may be used in a form of a reacted substance of plural kinds of polyisocyanates, a reacted substance of an ethyleneoxide added product of methanol and ethanol and polyisocyanate, or compounds having an isolated isocyanate group obtained by means of reacting a compound having 2 or more active hydrogen atom in one molecule and polyisocyanate.

As a polyol having an active hydrogen atom used for synthesizing the polyurethane resin of the present invention, mainly, graft or dispersed and denatured substances to low molecular weight polyol, polyether, polyester polyol, polyether ester polyol, polycarbonate polyol and polyether polyol, high molecular weight polyol such as a hydrocarbon-skeleton polyol and their poly-addition products.

As a polyurethane resin of a water-soluble or water-dispersed emulsion, three kinds, i.e., an anion-type self-emulsifying type, a nonion-type self-emulsifying and an enforced emulsifying type are known. In order to obtain the anion-type self-emulsifying type water-soluble or water-dispersed emulsion polyurethane resin, there are two methods. Namely, a method to introduce a polar group such as sulfonic acid, phosphoric acid and carbonic acid at a polyol portion reacted with polyisocyanate and a method to introduce a polar group such as sulfonic acid, phosphoric acid and carbonic acid by the use of diols, diamines and 2-(2-aminoethylamino)ethanol, which are used when a chain extension reaction is conducted, after polyisocyanate and polyol are reacted. In this occasion, if a counter ion such as triethylamine and diethylamine is appropriately introduced in a reaction process, a water-dispersed emulsion having a particle size to be targeted can be obtained. As a polyol starting material having a carboxyl group, 2,2-bis(hydroxymethyl)propionate, 2,2-bis(hydroxymethyl)butanic acid, 2,5,6-trimethoxy-3,4-dihydroxyhexanenic acid and 2,3-dihydroxy-4,5-dimethoxypentanic acid are cited.

As a polyol starting material not having a carboxyl group, ethylene glycol, 1,2-propanediol, 1,3-propanediol, 1,2-butanediol, 1,3-butanediol, 1,4-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, ethyleneglocol, propyleneglycol, diethyleneglycol, dipropylene glycol, triethylene glycol, tetraethylene glycol, neopentyl glycol, pentaethylene glycol, hexaethylene glycol, heptaethylene glycol, dipropylene glycol, glycerin, trimethylol propane, 1,2,6-hexanetriol, triethanol amine, pentaerysrytol, ethylenediamine, trilenediamine, diphenylmethanediamine, tetramethylol cyclohexane, methylglycocide, 2,2,6,6-tetrakis(hydroxymethyl)cyclohexanol, diethylenetriamine, solbitol, mannitol, zursitol and sucrose are cited.

Among high molecular weight polyols, as a polyester type, dimethylol propionate, poly(ethyleneadipate), poly(diethyleneadipate), poly(tetramethyleneadipate), poly(hexamethylene adipate), poly(neopentyladipate), poly-ε-caproractone and their copolymers are cited. In addition, as a polyether type compounds, polypropylene glycol, polyethylene glycol, polytetramethylene glycol, ethyleneoxide/propylene oxide copolymers, THF/ethylene oxide copolymers, THF/propylene oxide copolymers and their copolymers are cited.

As described above, among high molecular weight polyols, as a polycarbonate type, polycarbonate ester compounds exhibited in the following Formula (I) is cited.

Formula (I)

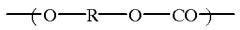

wherein R represents a divalent combination group.

As R in the above-mentioned Formula (I), an aliphatic group dioxane compound residual group, an aliphatic group dioxy compound residual group containing an aromatic group and an aromatic group dioxane compound residual group are cited. However, R is not limited thereto.

As an aliphatic group dioxane compound residual group, the following compounds are cited.

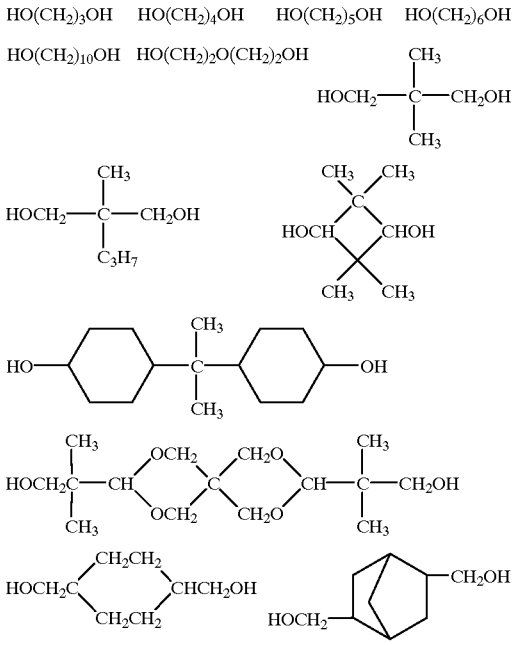

As an aliphatic diaxane compound residual group containing an aromatic group, the following compounds are cited.

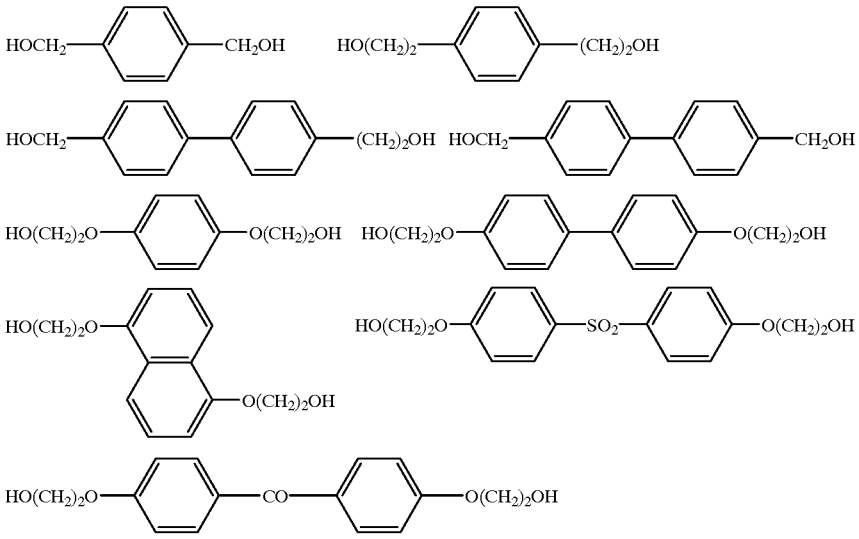

-continued
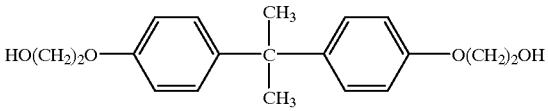
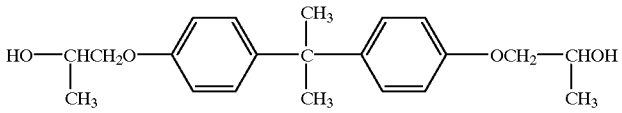
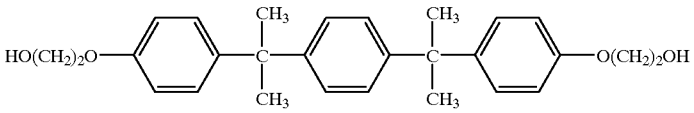
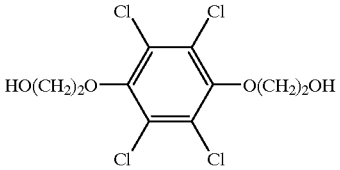
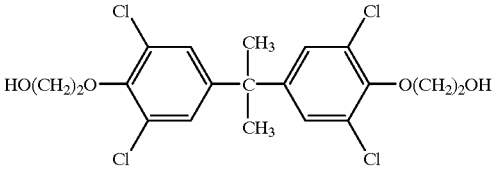
As an aromatic group dioxy compound residual group, the following compounds are cited.
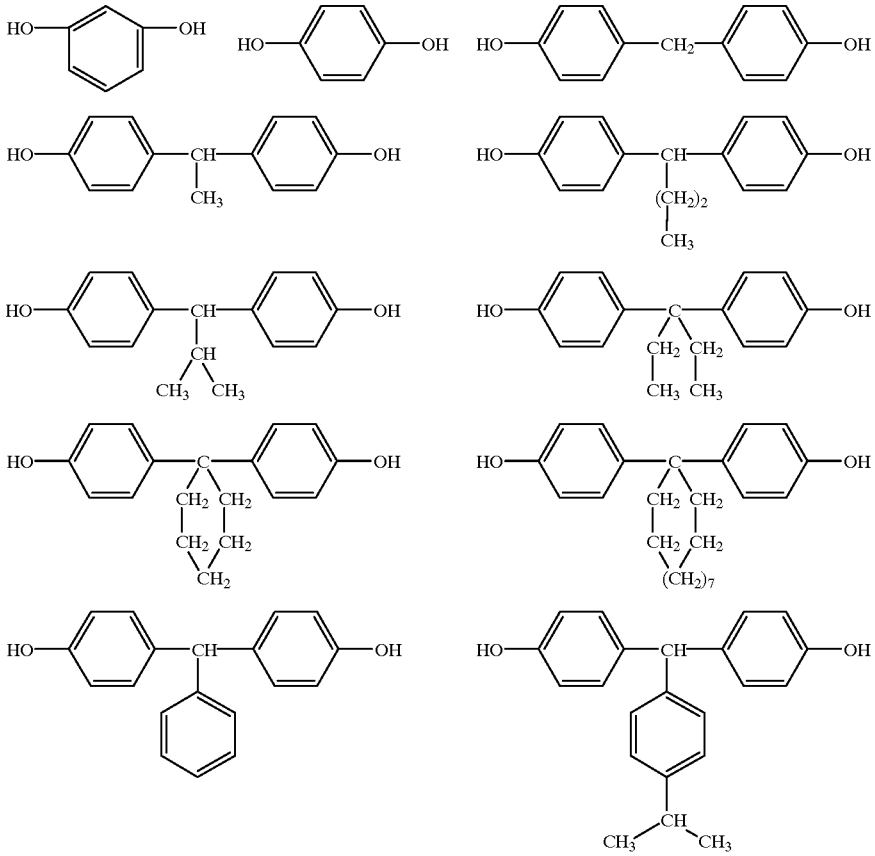

-continued
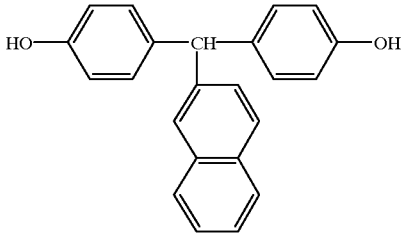
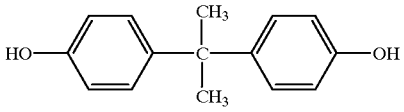
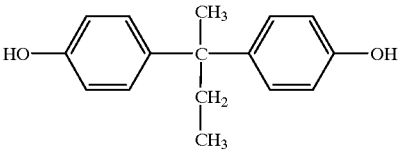
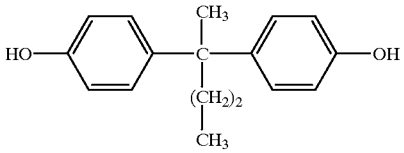
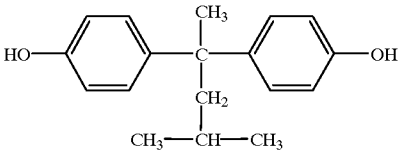
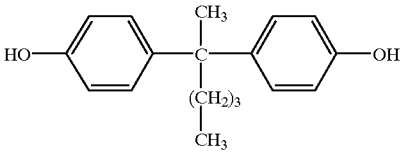
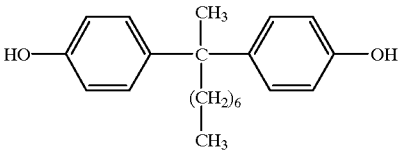
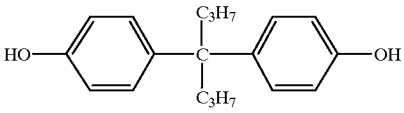
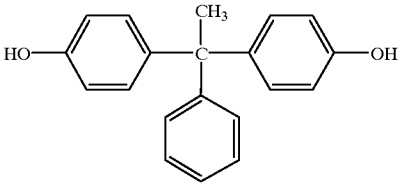
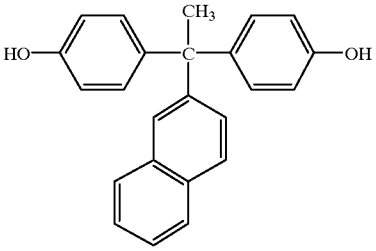
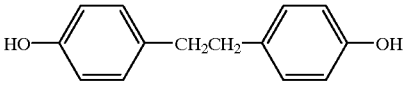
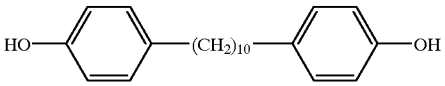
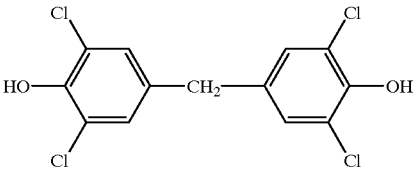
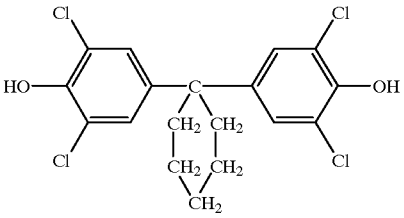
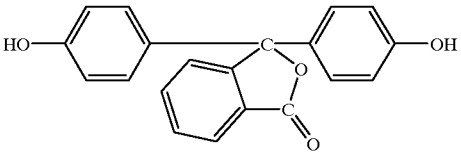
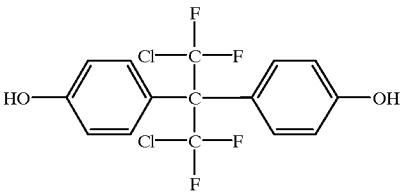
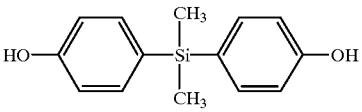
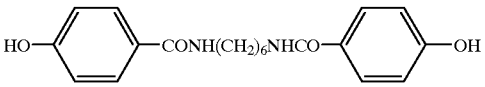

-continued
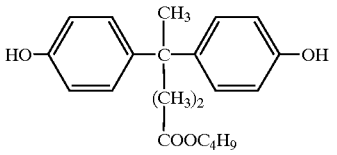
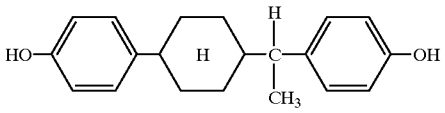
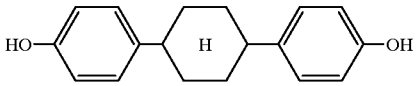
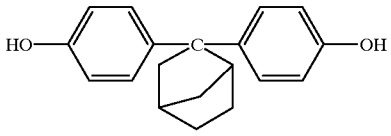
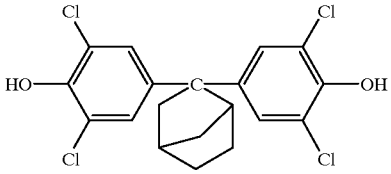
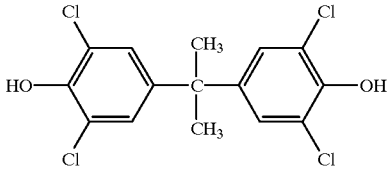
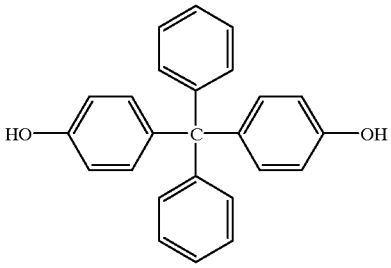
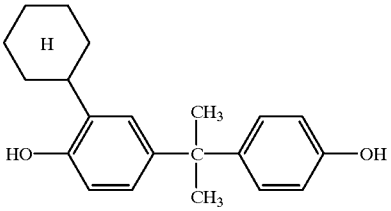
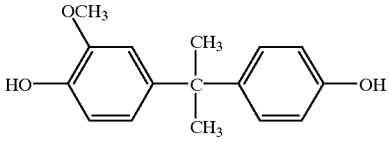
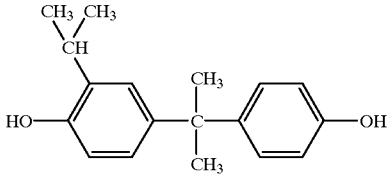
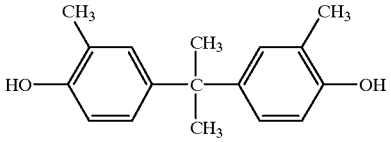
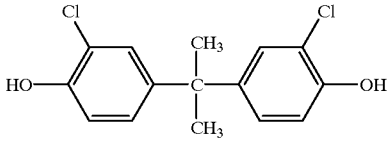
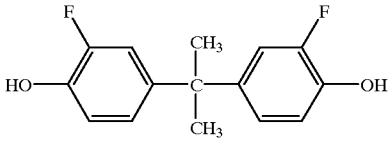
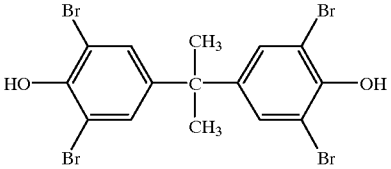
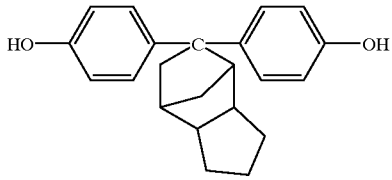
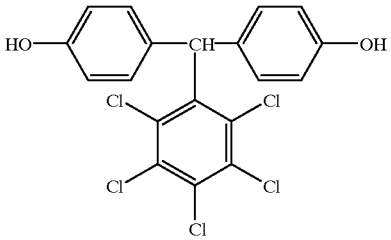
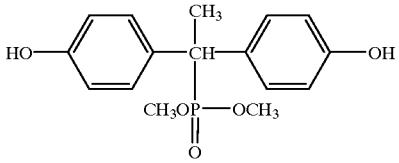
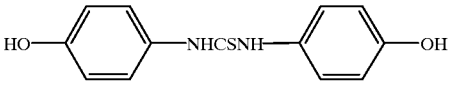

-continued
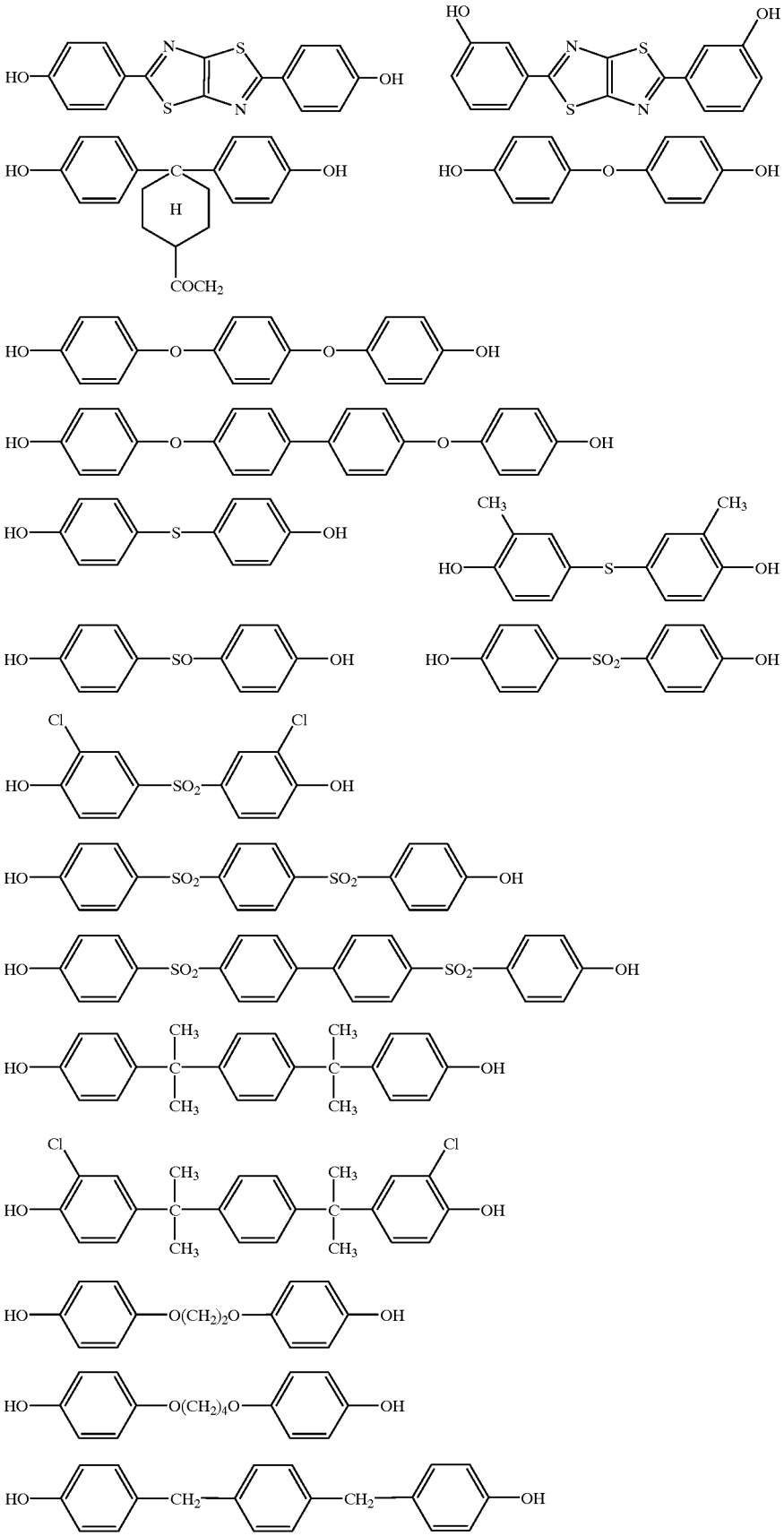

-continued

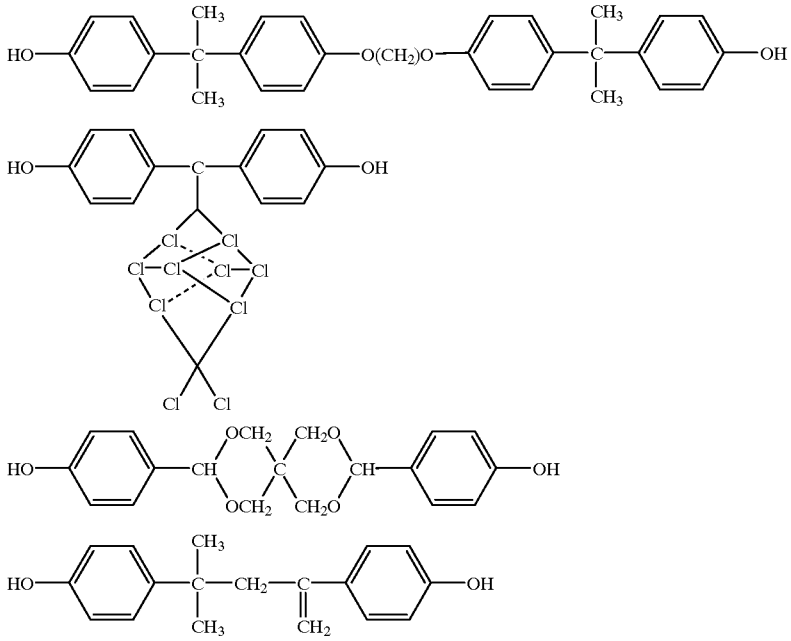

"Polycarbonate" referred to as in the present invention includes a type synthesized from the above-mentioned single raw material, a type in which different dioxane compounds are raw materials and hetero-binding copolymers having a carbonate bond and other bonds in the main chain.

The polyurethane resins of the present invention are polymers containing an urethane bond in a polyurethane resin constituting monomer. Preferably, they contain at least one polycarbonate ester in the polyurethane resin constituting monomer. More preferably, they are characterized to contain at least an aliphatic group polyisocyanate residual group and a carboxyl group in the polyurethane resin constituting monomer.

There may be various combinations of the above-mentioned polyisocyanates and polyols from the viewpoint of dissolvability of added product, hydrophobicity and ease of manufacturing the added products.

Numerous water-dispersed polyurethane emulsions capable of being used in the present invention are known. Among these, a thermal reactive polyurethane emulsion, having relatively low to middle molecular weight utilizing blocked isocyanate groups are cited. As another type, thermoplastic polyurethane emulsions having relatively high molecular weight in which a straight-chained structure is a main structure. By introducing a hydrophilic group such as an anion cation or non-ion in an urethane resin skeleton, these are subjected to self-emulsification or dispersion. Or, an emulsifier is added to a hydrophobic resin to be dispersed in water. "Aqueous polyurethane resin" of the present invention includes both of the above-mentioned thermal reactive type aqueous polyurethanes and thermoplastic aqueous polyurethanes.

"Thermal reactive type" of the present invention is a type which comes to be a network structure due to thermal reaction to obtain water excellent resistance property and adhesivity onto a sticked material. "Thermoplastic property" is a type in which a membrane layer is formed only by drying in at ambient conditions having no necessity of thermal heating. In the present invention, from the viewpoints of facility, heat resistance of the adhered material and energy saving, it is preferable to use thermoplastic type polyurethane resins.

Practical synthesis methods of the above-mentioned aqueous polyurethane resins are disclosed in detail in Japanese Patent O.P.I. Publication Nos. 127306/1993, 67328/1994, 293821/1994, 96919/1992, 63716/1983, 80320/1983, 301251/1988, 151753/1981 and 269723/199010950/1995. In addition, synthesis methods of polyurethane are described in detail in "Polyurethane Handbook" (1985) written by Gunther Otter, "Polyurethane Form" (1987) written by Yoshio Imai and "Aqueous Paint and Coating Technology" (1992) published by Technological Information Association.

As commercially available thermoplastic water-soluble polyurethane resins or water-dispersed emulsion polyurethane resins, the following materials are cited: However, the present invention is not limited thereto. Namely, Super Flex Series Nos. 107, 110, 126, 150, 160, 190, 300, 361, 410, 460, 750 and 820 and Super Flex E Series E-2000, E-2500 and E-4500 produced by Dai-ichi Kogyo Seiyaku Co., Ltd., Takerack W series Nos. W-6015, W-621, W-511, W-512A, W-635, W-7004, AW-605 and ACW-54HD and Takerack XW series containing a silanol group respectively produced by Takeda Chemical Co., Ltd. and HYDRAN series produced by Dai-Nippon Ink Chemical Co., Ltd. As thermal reactive type aqueous polyurethane resins, Elastron series produced by Dai-ichi Kogyo Seiyaku Co., Ltd. and Takenate WB series Nos. WB-700, WB-710, WB-720, WB-730 and WB-920 produced by Takeda Chemical Co., Ltd. are cited. In addition, of these, as compounds containing a polycarbonate ester, an aliphatic group polyisocyanate residual group and a carboxyl group, Super Flex 410 produced by Dai-ichi Kogyo Seiyaku Co., Ltd., etc. are cited. Again, the present invention is not limited thereto.

As a protective covering layer resin used in the present invention, a water-soluble polyurethane resin or a water-dispersed emulsion polyurethane resin respectively having two or more compositions can also be used in combination. In addition, in a protective covering layer resin used in the present invention, as necessary, layer-production aids, leveling agents, high boiling solvents, higher fatty acids, higher fatty acid esters, higher alcohols, viscosity provision agents, silane coupling agents such as aminosilane, epoxysilans and acrylic silanes, cross linking agents, inorganic substances such as silicas, silicones, fluid paraffin, surfactants, viscosity-increasing agents, UV absorbers, deodorants, anti-mildew agents, fluorescent brightening agents, anti-electrically static agents, aqueous dyes, pigments, parting agents, acrylic or ethylene vinyl acetate type aqueous polymers, natural rubbers ordinary synthetic resin emulsions such as synthetic rubber latex including SBR and NBR can be used in combination or can be blended therein. However, the protective covering layer of the present invention preferably contains the aqueous polyurethane resin of the present invention by 60 wt % or more.

An aqueous polyacrylic resin referred to as in the present invention will be explained.

In the present invention, an aqueous polyacrylic resin is referred to as a water-dispersed emulsion type polyacrylic resin.

In the present invention, a water-dispersed emulsion is referred to as an emulsion dispersed with water as a dispersant.

A thermal reactive aqueous polyacrylic resin of the present invention forms a layer due to thermal reaction. An aqueous thermoplastic polyacrylic resin is a type in which a layer is formed at a drying temperature while it is not specifically necessary to be heated. In the present invention, it is preferable to use a thermal reactive type resin, from viewpoint of water resistance property and stickness onto a covered material.

Generally, the thermal reactive polyacrylic resin and the thermoplastic polyacrylic resin are respectively general terms of acrylic polymers having at least one acrylic ester group or an acrylic acid. An acrylate used for an aqueous thermal reactive type and a thermoplastic polyacrylic resin type monomer of the present invention, there is no practical limit. However, the following ones are cited.

Ethylacrylate
Butylacrylate
2-ethylhexyl acrylate
Methylmethacrylate
Methylacrylate
Methacrylic acid
Acrylic acid
Itaconic acid
Hydroxyethylmethacrylate
Hydroxypropylmethacrylate
Dimethylaminoethylmethacrylate
Glycygyl methacrylate
Neopentylglycol diacrylate
Pentaerysrytol triacrylate
1,6-hexanediol diacrylate
Trimethylol propane triacrylate
Tetraethylene glycol diacrylate
1,3-butylene glycol dimethacrylate
Ethylene glycol dimethacrylate
Pentaerystol tetraacrylate
1,6-hexanediol dimethacrylate
Ethylene glycol diacrylate
Diethylene glycol diacrylate
Glycerol diacrylate
Glycerol triacrylate
1,3-propanediol diacrylate
1,3-propanediol dimethacrylate
1,2,4-buthanetriol trimethacrylate
1,4-cyclohexanediol diacrylate
Pentaerysrytol diacrylate Water-dispersed acrylic emulsions of the present invention are numerously known.

As commercially available aqueous thermal reactive polyacrylic resins of the present invention and aqueous thermoplastic polyacrylic resins of the present invention, Brightone series FC-102, FC-303 and FC-306 produced by Sakata Inks for aforesaid thermal reactive polyacrylic resin and Pan Flock series, High Set series and New Frontier series (TE-600, GX-8430, PEM-1000, A-229E and S-23A) produced by Dai-ichi Kogyo Seiyaku Co., Ltd. for aforesaid thermoplastic polyacrylic resin are cited. In addition, Zemrak series produced by Kanegafuchi Chemical Industry are also cited.

In addition, as shown in Japanese Patent O.P.I. Publication No. 118630/1995, by localizing a hydrophilic group in a water-dispersed acrylic emulsion on the surface of emulsion grains in the form of grafting or a copolymer in the main polymer, shortcomings such as voids and unevenness are prevented so that change of a layer due to aging is extremely inhibited.

An aqueous polyacrylic resin of the present invention includes the above-mentioned aqueous thermal reactive polyacrylic resins and aqueous thermoplastic polyacrylic resins.

As a resin for a protective covering layer of the present invention, graft or a copolymer with two or more kinds of acrylate, siloxane, carbinol, N-vinylpyrrodidone, vinyl acetic acid, acrylonitrile, acrylamide, stylene, methylolacrylic acidmaleic acid anhydride. Preferably, an arylic resin, a silicone resin and an acrylic urethane resin are cited.

Manufacturing methods and properties of an aqueous thermal reactive polyacrylic resin and an aqueous thermoplastic polyacrylic resin of the present invention are described in "Aqueous Paint and Coating Technology" (published by Technological Information Association) and Japanese Patent O.P.I. Publication Nos. 104370/1980, 19676/1987, 158084/1989, 190911/1993, 214006/1993 and 118630/1995. These resins can easily be manufactured.

If the outermost layer of the information-recording material of the present invention is composed of a protective covering layer of the information-recording material having such a protective covering layer of the present invention, printing suitability on inks other than aqueous types is improved. Therefore, manual inputting of comments by means of an oil-based felt pens and addition of a thermal transfer image and text information by means of thermosensitive transfer become possible, resulting in an information-recording material having high added value.

In addition, concurrently with the protective covering layer on the outermost layer on an image carrier side from the support, by providing aforesaid protective covering layer on the outermost layer (the back layer) on a side opposite to the image carrier layer side from the support, an information-recording material in which water resistance property and drawing (transcription) property on the rear side are improved such as a photographic post cards can be produced.

Added amount of the protective covering layer of the information-recording material of the present invention may be set depending upon the application. Ordinarily, 0.1–10 g and preferably 1–5 g per $m^2$. However, in the case of special application, i.e., when it is used under a severe environmental conditions such as for a poster for outdoor exhibition, 8 g or more per $m^2$ is preferable and, when copy-prevention of an image must be considered, 20 g or more per $m^2$ is more preferable.

The embodiment of the information-recording material of the present invention is to provide a protective covering layer composed of an aqueous polyurethane resin or an aqueous polyacrylic resin on an image carrier layer composed of a hydrophilic polymers used in the support. The information-recording material is specifically preferably used for a color photographic print, a black-and-white photographic print, a post card, a reversal photographic print, an index print, an automatic positive photographic print, a color photographic negative film, a black-and-white negative film, an X-ray photographic film for medical use, a micro-photographic film, an "instant" photographic print, a thermal developing photographic print, a silver-dye-bleached print, a dye transfer method photographic print and an ink jet printing material employing an aqueous ink.

As a method for forming the protective covering layer in the information-recording material, any of several conventional methods may be used. However, it is desirable to select the most appropriate means depending upon the function of the information-recording material.

For example, in an ink jet printing material, spray coating and ink jet coating which utilize an ink jet head are preferable. In addition to the above-mentioned methods, as conventional coating methods, a method which dips the information-recording material in a polyurethane water dispersed solution or in a polyacrylic water dispersed solution and which then dries, a roll coating method, a graveure coating method, an air knife coating method, an extrusion coating method, a curtain coating method, a wire bar coating method and a method which coats the solution which oozed out through a cloth or a sponge-like material Specifically, if the information-recording material is a photographic light-sensitive material, it is allowed to pass through the photographic light-sensitive material in a polyurethane water-dispersion or its dilution tank containing an aqueous polyacrylic resin. It is also allowed to pass through the photographic light-sensitive material in a washing or stabilizing bath containing dispersion of an aqueous polyurethane or an aqueous polyacrylic resin prior to the drying process in photographic processing.

The solid concentration of the aqueous polyurethane or the aqueous polyacryl may be arbitrarily set depending upon coating methods and the added amount of resin considered to be necessary. Generally, it is about 1–40%.

The drying temperature of an aqueous thermal reactive type or a thermoplastic polyurethane resin or a polyacrylic resin used in the present invention is not specifically limited. When the information-recording material is a photographic print, it is preferably 110° C. or less from the viewpoint of heat resistance property of the support, and more preferably 60–110° C.

An "aqueous polymer" which forms an image carrier layer of the present invention practically refers to gelatin, cellulose fiber, natural polymers such as polysaccharides and polymers having high moisture-absorption property such as PVA and PRG. More particularly, if the information recording material is a photographic light-sensitive material, it refers to gelatin (and depending upon the kind thereof, polysaccharides such as dextrane may be included). In addition, in the case of an ink jet printing material, PVA and gelatin are commonly used.

EXAMPLES

Hereinafter, the present invention will be explained in detail referring to examples.

A sample image was printed on ink jet printer paper (a glossy film exclusively used for High Quality Glossy Paper produced by Epson Co., Ltd.) employing an ink jet printer (Esper Mach-jet Color). Incidentally, as an ink, MJIC2C produced by Epson was used.

Onto the above-mentioned printing material, a compound shown in Table 1 in which the solid component density was 20% was sprayed to be coated in such a manner that the added amount of resin was 1 g per $m^2$. The resulting sheet was dried for 15 minutes in a drying chamber set at 80° C.

(Compounds of the comparative invention used in this test are described in the specification and Example in Japanese Patent O.P.I. Publication No., 212640/1991) The above-mentioned Samples 101–110 shown in Table 1 were subjected to the following tests.

Table 1 shows the results thereof.

The compounds described in Example were replaced with Elastron series produced by Dai-ichi Kogyo Seiyaku Co., Ltd. and Takenate WB series WB-700, WB-710, WB-720, WB-730 and WB-920 produced by Takeda Chemical Ind., Co., Ltd. which are thermally reactive moisture-containing polyurethane resin, and further the drying temperature was also changed to 100° C. However, the effects of the present invention were observed.

Test 1: Adherence Property of Stains

On a white background in a printing material, a drop of instant coffee at a 5% density and temperature was 60° C. was placed. After 30 seconds, the drop was wiped with a paper tissue (Scottie: produced by Crea Inc.). In this occasion, coffee stain remained on the printing material and resultant scratch due to wiping were observed.

<Coffee Stain>

A: No discernible stain

B: A slight stain remained

C: A noticeable stain remained

<Scratching>

A: No discernible scratching

B: Slight scratching occurred

C: Noticeable scratching occurred

Test 2: Adherence and Removal of Fingerprints

The adherence property of fingerprints on portions where a finger was pressed and the removal property, from where aforesaid fingerprint was wiped out after 30 seconds with a paper tissue was evaluated.

<Adherence of Fingerprints>

A: No fingerprints were sticked

B: Fingerprints were slightly adhered

C: Fingerprints were noticeably adhered

<Removal of Fingerprints>

A: The fingerprint is completely removed, or no fingerprint was initially adhered from the beginning B: The fingerprint is almost completely wiped off C: The fingerprint was barely wiped off Test 3: Evaluation on Glossiness In accordance with the method stipulated in JISZ-8741, glossiness was measured at an incidence angle=reflection angle=60° to be evaluated. The larger the value is, the better the glossiness is.

Test 4: Water Resisting Property

A sample cut to a dimension of 15×15 cm was immersed in pure water at 20° C. for 3 minutes. Following this, moisture on the surface was wiped, and then increase ratio of weight was calculated. The smaller this value is, the better was the water resisting property of the protective and lamination layer.

Test 5: Surface Adhesion Property

Image surfaces of a sample in which each of them was cut to 3.5×10 cm were sealed each other. The sealed plate was sandwiched between a metal plate. Under a condition that a load of 1 kg was applied, the metal plate was left for 3 days under 40° C. and 80% RH. Following this, the sample was taken out so that sealing property of the sample could be evaluated.

A: No adhesion occurred

B: The samples were sealed to each other though, they can be peeled off without damage C: When peeled apart, damage occurred on one or both images, to the protective and lamination layer The above-mentioned Samples 201-210 shown in Table 2 were subjected to the above-mentioned tests 1–5 and the following test 6. The results are shown in Table 2.

The compounds described in Example were replaced with Elastron series produced by Dai-ichi Kogyo Seiyaku Co., Ltd. and Takenate WB series WB-700, WB-710, WB-720, WB-730 and WB-920 produced by Takeda Chemical Ind., Co., Ltd. which are thermal reactive moisture-containing polyurethane resins, and drying temperature was also changed to 100° C. However, the effects of the present invention were observed.

TABLE 1

| Samples No. | | Test 1 | | Test 2 | | | | Test 5 |
|---|---|---|---|---|---|---|---|---|
| Resin used in a protective and covering layer. | | Stain sticking | Wiping scratch | Fingerprint sticking | Wiping property of fingerprint | Test 3 Glossiness | Test 4 Water (%) | Surface sealing property |
| 101 Having no protective and covering layer (blank) | Comp. | C | B | B | B | 48 | 4.0 | B |
| 102 Eastman WHS*1 (produced by Eastman Cemical) | Comp. | C | C | B | B | 51 | 3.5 | B |
| 103 Eastman WD SIZE*2 (produced by Eastman Chemical) | Comp. | C | C | B | B | 52 | 3.2 | B |
| 104 Super Flex 150*3 (produced by Dai-ichi Kogyo Seiyaku) | Inv. | B | B | A | A | 55 | 0.5 | A |
| 105 Super Flex 410*4 (produced by Dai-ichi Kogyo Seiyaku) | Inv. | A | A | A | A | 58 | 0.1 | A |
| 106 EX-200A (produced by Takamatsu Yusi) | Comp. | C | C | C | C | 35 | 4.3 | C |
| 107 Finetex ES-850 (produced by Dai-Nippon Ink Co. Ltd.) | Comp. | C | C | A | C | 31 | 4.5 | C |
| 108 FC-102 (Sakata Inks Co. Ltd.) | Inv. | A | A | B | B | 56 | 0.1 | A |
| 109 FC-303 (Sakata Inks Co. Ltd.) | Inv. | A | A | B | B | 49 | 0.3 | B |
| 110 FC-306 (Sakata Inks Co. Ltd.) | Inv. | A | A | B | A | 50 | 0.4 | A |

*1Polyester Composed of dietylene glycol, terephalic acid, sulfoisophthalic acid and aliphatic dicarboxylic acid
*2Polyester composed of isophthalic acid, diethylene glycol and a sulfo-derivative of dicarboxylic acid
*3Estel-ether-containing polyurethane
*4Carbonate-containing polyurethane

Example 2

A sample image was exposed to a photographic paper (Konica Color Type QA: produced by Konica Corporation), and then, subjected to ordinary photographic processing to prepare a color print photograph. On this sample, a resin shown in Table 2 in which solid component density was 20% was sprayed to be coated with a wire bar in such a manner that the added amount of resin was 2 g per 1 $m^2$. The resulting sheet was dried for 15 minutes in a drying chamber set at 80° C. (Compounds of the comparative invention used in this occasion were described in the specification and Example in Japanese Patent O.P.I. Publication No., 212640/1991)

Test 6: Storage Stability of the Image

The sample was left for 3 weeks in a temperature-constant tank at 85° C. and 60% RH. Following this, the degree of deterioration of the sample image was visually observed. The sample in which color fading was most vigorously was ranked as 1, and the sample in which color fading was least was ranked as 5.

TABLE 2

| Samples | | Test 1 | | Test 2 | | | | Test 5 | Test 6 |
|---|---|---|---|---|---|---|---|---|---|
| Resin used in a protective and covering layer. | | Stain sticking | Wiping scratch | Fingerprint sticking | Wiping property of fingerprint | Test 3 Glossiness | Test 4 Water (%) | Surface sealing property | storage stability of Image |
| 201 Having no protective and covering layer (blank) | Comp. | C | B | B | B | 89 | 6.2 | B | 1 |
| 202 Eastman WHS*1 (produced by Eastman Chemical) | Comp. | C | C | B | B | 91 | 5.3 | B | 2 |

TABLE 2-continued

| Samples | | Test 1 | | Test 2 | | | | Test 5 | Test 6 |
|---|---|---|---|---|---|---|---|---|---|
| Resin used in a protective and covering layer. | | Stain sticking | Wiping scratch | Fingerprint sticking | Wiping property of fingerprint | Test 3 Glossiness | Test 4 Water (%) | Surface sealing property | storage stability of Image |
| 203 Eastman WD SIZE*2 (produced by Eastman Chemical) | Comp. | C | C | B | B | 92 | 4.5 | B | 3 |
| 204 Super Flex 150*3 (produced by Dai-ichi Kogyo Seiyaku) | Inv. | B | A | A | A | 97 | 0.5 | A | 5 |
| 205 Super Flex 410*4 (produced by Dai-ichi Kogyo Seiyaku) | Inv. | A | A | A | A | 102 | 0.1 | A | 4 |
| 206 Ex-200A (produced by Takamatsu Yusi) | Comp. | C | C | C | C | 70 | 7.5 | C | 2 |
| 207 Finetex ES-850 (produced by Dai-Nippon Ink Co. Ltd.) | Comp. | C | C | A | C | 68 | 7.7 | C | 2 |
| 208 FC-102 (Sakata Inks Co. Ltd.) | Inv. | A | A | A | A | 94 | 0.0 | B | 5 |
| 209 FC-303 (Sakata Inks Co. Ltd.) | Inv. | A | A | A | A | 90 | 0.2 | B | 5 |
| 210 FC-306 (Sakata Inks Co. Ltd.) | Inv. | A | A | A | A | 92 | 0.3 | A | 5 |
| 211 PEM-1000 (produced by Dai-ichi Kogyo Co., Ltd.) | Inv. | A | A | B | A | 89 | 0.5 | B | 5 |

*1 Polyester Composed of dietylene glycol, terephalic acid, sulfoisophthalic acid and aliphatic dicarboxylic acid
*2 Polyester composed of isophthalic acid, diethylene glycol and a sulfo-derivative of dicarboxylic acid
*3 Estel-ether-containing polyurethane
*4 Carbonate-containing polyurethane In the present invention, compounds used for the comparative examples have partially excellent performances in terms of finger stickness and glossiness. However, they are insufficient in terms of wiping property of the fingerprint, scratch durability, water resisting property, sealing property and image storage stability. Specifically, there are several samples of the comparative invention having worse water resisting property compared with a blank product having no protective covering layer, that is considered to be influence of moisture absorption property of the resin coated.

As is apparent from the results of Tables 1 and 2, the information recording material of the present invention is so excellent in terms of water resisting property, sticking property and wiping property of a fingerprint, adherence property of stain, scratch durability, sealing property and image storage stability that its added values are so high.

Owing to the present invention, it is possible to provide an information recording material having high added values wherein it is excellent in terms of water resisting property, anti-scratch property, glossiness, image storage stability and prevention of a fingerprint sticking, it is easy to wipe off contamination and, even when said material is folded to be of a two-page spread type, its facing pages do not stick to each other simply and at a low cost.

Figure 2:
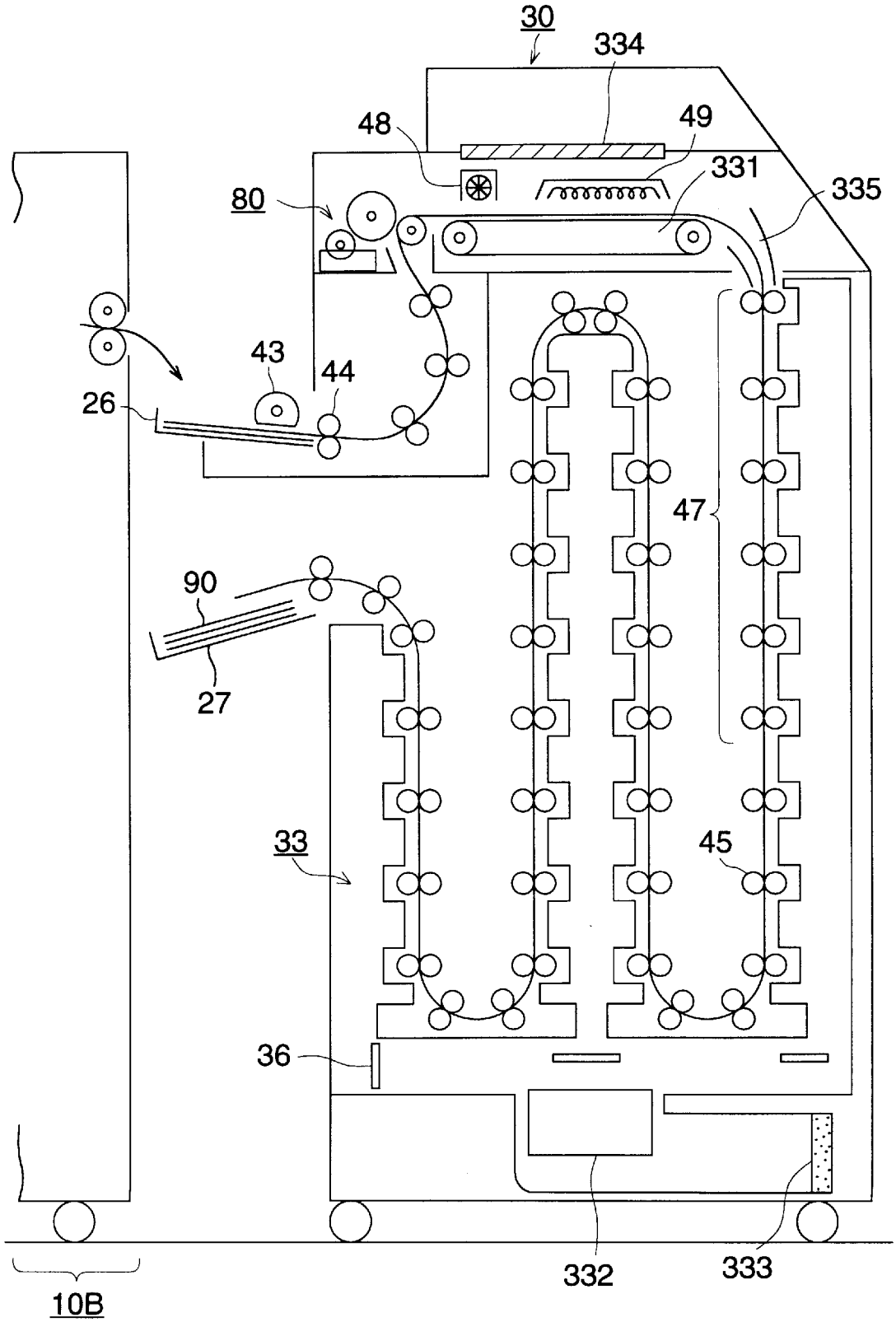
FIG. 2 illustrates a drawing of another sheet material coating apparatus.
Figure 4:
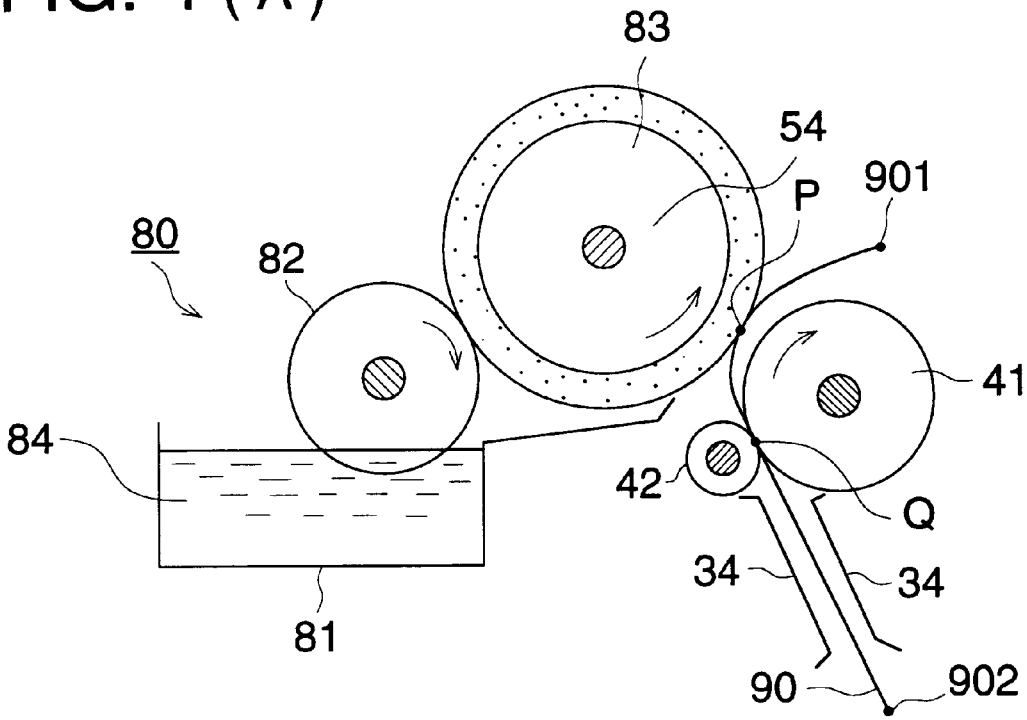
FIG. 4(A) and FIG. 4(B) illustrate another schematic drawing of a sheet material coating apparatus.
Figure 4:
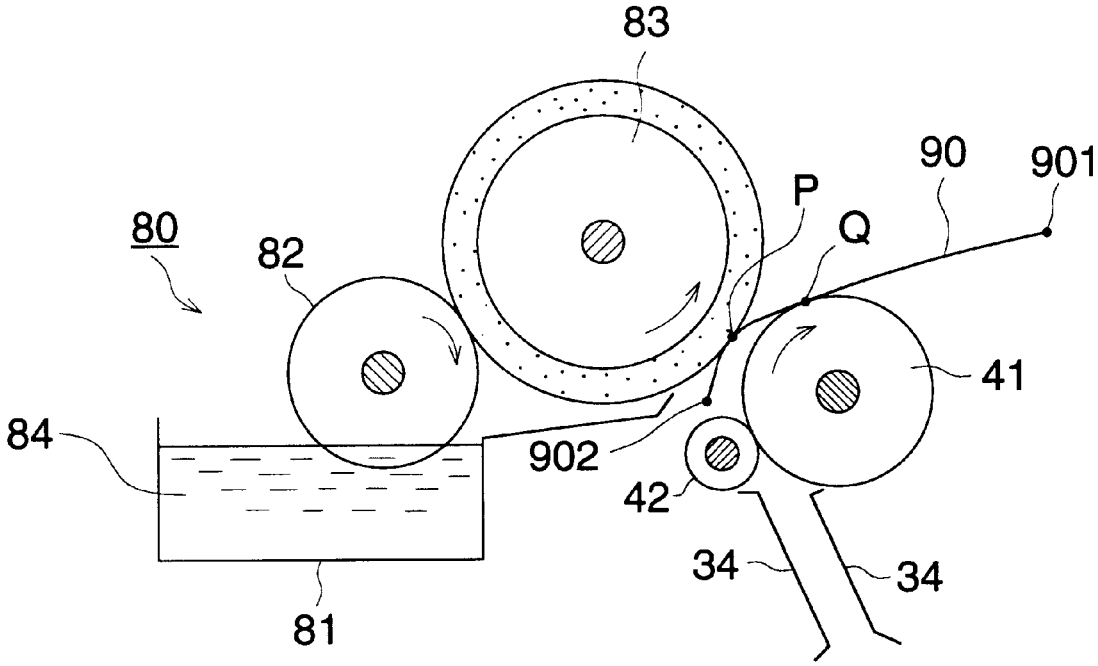

FIG. 1 shows a block diagram of a color photographic printer in which a sheet material coating apparatus of the present invention is integral. FIG. 2 shows a block diagram of another sheet material coating apparatus. FIG. 3 shows a schematic block diagram of a sheet material coating apparatus. FIG. 3(A) shows a plan view, and FIG. 3(B) shows a cross sectional view. FIG. 4 shows a schematic block diagram of another sheet material coating apparatus. FIG. 4 shows a block diagram in which the leading end of the sheet material is coated, and FIG. 4(B) shows a block diagram in which the trailer end of the sheet material is coated. FIG. 5 shows a schematic block diagram of still another sheet material coating apparatus. FIG. 5(A) shows a block diagram in which the leading end of the sheet material is coated, and FIG. 5(B) shows a block diagram in which the trailer end of the sheet material is coated.

In FIG. 1, color photographic printer 10 is composed of printer section 10A, developing section 10B and sheet material coating apparatus 30 of the present invention.

In the above-mentioned printer section 10A, a roll type color paper fed from magazine 11 is conveyed by means of rollers 19, and cut by cutter 15. Following this, color paper 90, cut sheet material, is conveyed to a masking portion (not illustrated) by means of belt 17. In order to cause flat color paper 90, aforesaid color paper is sucked with vacuum 18. Here, a negative film positioned on negative carrier 12 is illuminated with lamp 13. Color paper 90 is image-formed by means of lens 14, and exposed by means of an exposure mechanism (not illustrated) to be printed. Following this, color paper 90 is conveyed to developing section 10B along with conveyance path 16.

In the above-mentioned developing section 10B, color paper 90 passes through developing tank 21, fixing tank 22, stopping tank 23, washing tank 24 and drying chamber 25 to be subjected to photographic processing. Following this, it is conveyed to a sheet material coating apparatus.

In sheet material coating apparatus, a protective covering solution was coated on the surface of color paper 90. Aforesaid color paper is dried at a 30 cm length belt section at uncontactly, and also dried in a drying chamber by means of a heat air circulation type using a drier.

Color paper 90 is color paper for silver halide color photographic print, in which a hydrophilic binder gelatin is coated on an image coating material. The width of the color paper ranges 90–220 mm, and the length thereof ranges 120–500 mm. The range of stiffness of the color paper is 3–50 gf·cm. The above-mentioned stiffness is in the direction of conveying the color paper for coating on the sheet material. Incidentally, the sheet material coating apparatus will be detailed in FIG. 3.

Next, FIG. 2 explains another example of sheet material coating apparatus 30 in FIG. 1. Sheet material coating apparatus 30 is connected to the post-process of developing section 10B. Sheet material 90 sent from developing section 10B is stocked in tray 26. Following this, sheet material 90 is sent by means of rollers 43. Sheet material is coated by means of coating means 80. Following this, about 30 cm length belt drying section 331 blows air with fan 48 without contact. Sheet material 90 is pressed downward while it is dried by means of heater 49, and is conveyed for about 4 seconds. During aforesaid time, conveyance conditions can be observed through window 334. Following this, the sheet material enters drying chamber 33 guided by guide plate 335. At an inlet of drying chamber 33, the coating surface of sheet material 90 is conveyed by rollers 47 made of Delrin, Teflon and silicone rubber using non-viscosity type. In drying chamber 33, the length of drying is 2.25 m. External air is inputted through filter 333 so that the sheet material is dried by means of temperature circulation system by drier 332. Incidentally, when feeding air, direction of air and amount of air are regulated by means of regulation plate 36. The sheet material is drained to tray 27 after finishing of drying.

In FIGS. 3 and 4, schematic drawings of a sheet material coating apparatus shown in FIGS. 1 and 2 will be explained. In the first coating section between the leader position of sheet material 90 and a prescribed position, sheet material 90 is conveyed while being coated due to driving of roller 41 and roller 42. Incidentally, the above-mentioned "prescribed position" is refers to as a position where the trailing position 902 of sheet material 90 is separated from rollers 41 and 42 (the first conveyance means).

As shown in FIG. 4(A), in the first coating section between the leader position of sheet material 90 and a prescribed position, sheet material 90 is supported by roller 41 and roller 42. The sheet material is curved receiving external force at contact point P illustrated. By means of stiffness by sheet material 90, reaction due to the above-mentioned curve occurs at contact point P (the first reaction force generation means).

As shown in FIG. 4(B), in the second coating section between the prescribed position and the retailer end position, sheet material 90 is curved receiving external force with contact point Q as a fulcrum due to its own weight. Due to stiffness of sheet material 90, reaction force by means of the above-mentioned curve occurs (the second reaction force generation means).

As shown in FIG. 4(B), in the second coating section between the prescribed position and the retailer end position, coating roll 83 is pressed by means of reaction force due to the above-mentioned curve at contact point P. The sheet material is conveyed due to friction force by coating rollers 83. Sheet material 90 presses rollers 41 at contact point Q, and is conveyed due to its friction force (the second conveying mean).

In coating means 80, sheet material 90 is conveyed to coat coating solution 84 while pressing sheet material onto coating rollers 83 in which rubber 832 is provided circumferentially due to reaction force caused by the above-mentioned first or second reaction generation means. Coating solution 84 contained in coating solution container 81 is transferred to coating rollers 83 through rotating rollers 82. Incidentally, the circulation pump (not illustrated) circulates coating solution 84 at 5–700 cc per every minute.

Side plates 31 and 32 shown in FIG. 3 function bearings for shaft 821 for rollers 82, shaft 831 for coating rollers 83 and shaft 411 for backing roller 41. Pulse motor 51 rotates pulley 52, pulley 52 drives belt 53 and belt 53 rotates pulley 54 integral with coating roller 83 and gear 55. When gear 55 rotates, both gear 56 which is integral with back roller 41 and gear 57 which is integral with roller 82 rotate. Since gap G (see FIG. 3(B)) is provided which is larger than the thickness of the sheet material between the surface of roller 41 and that of coating roller 83 is provided, the coating solution is not sticked onto the surface of roller 41 when the sheet material is not coated.

In coating solution container 81, about 5 liter of coating solution is kept. Coating solution 84 is composed of a thermoplastic or thermal reactive resin, which is an aqueous synthetic resin component containing a polyurethane-containing resin and/or polyacrylic-containing resin.

Next, FIG. 5 explains a schematic drawing of another sheet material coating apparatus. Members having the same mechanical and functional effects as those in FIGS. 3 and 4 have the same numerals, and their explanation is omitted. Paired rollers 4 conveys sheet material 90. In addition, guide 35 guides for conveying sheet material 90.

Here, movement of the coating of sheet material in FIGS. 3 and 4 will be explained. When sheet material 90 is conveyed along with guide 34, end portion 901 of sheet material 90 crept between roller 41 and roller 42, and then the sheet material is conveyed so that the leader portion 901 of the sheet material 90 touches the surface of coating roller 83. On the other hand, coating solution 84 adhered on roller 82 is transferred onto the surface of coating roller 83. External force is added to sheet material 90 at contact point P due to coating roller 83 on which the above-mentioned coating solution 84 is adhered so that aforesaid sheet material is curved. Due to stiffness of sheet material 90, reaction force functions at contact point P. The above-mentioned reaction force of sheet material presses coating roller 83 so that the sheet material is coated while the trailing section 902 of sheet material 90 is conveyed until a position (a prescribed position) where the trailing section 902 is separated from roller 42. In addition, sheet material 90 is bent with contact point Q as a fulcrum due to its weight. The reaction force due to stiffness of sheet material 90 presses coating roller 83 at contact point P. The sheet material is coated while being conveyed.

Next, movement of coating the sheet material in FIG. 5 will be explained. First, sheet material 90 is conveyed by means of paired roller 45. The leader portion 901 of sheet material 90 crepts between guide 35 and roller 41. When leader portion 901 of sheet material 90 touches the circumferential portion of coating roller 83, the leader portion 901 of sheet material 90 moves counterclockwise since coating roller 83 is rotating in a counter-clockwise direction. Sheet material 90 receives external force at contact point P so that it is curved. Due to stiffness of sheet material 90, the reaction force functions at contact point P. Sheet material 90 is conveyed due to friction force by means of coating roller 83. Similarly, sheet material 90 is conveyed by means of friction force at contact point Q by roller 41. Sheet material 90 is conveyed to be coated while coating roller 83 is pressed at contact point P.

When trailing section 902 of sheet material 90 comes to a position (a prescribed portion) where it is separated from leading section 351 of guide 35, external force is given to contact point P with contact point R as a fulcrum due to its own weight of sheet material 90 so that the sheet material is curved. Due to its reaction force, sheet material 90 presses coating roller 83. Further, sheet material 90 is conveyed due to the friction force at contact point P by coating roller 83. In the same manner, the sheet material is conveyed due to the friction force by roller 41 at point R. The sheet material is conveyed to be coated while coating roller 83 is pressed at contact point P.

Hereinafter, a method of reversing the front surface and the rear surface of the sheet material of the embodiment referring to FIGS. 3 and 4. Coating roller 83 is placed with roller 83. In the first reversal area, from the leading end 901 of sheet material 90 to the prescribed position (a position where trailing section 902 of sheet material 90 is separated from roller 42), when sheet material 90 is conveyed along with guide 34, leading section 901 of sheet material 90 crepts between roller 41 and roller 42. Sheet material 90 is further conveyed and then leading end 901 of sheet material 90 touches the surface of roller 83. External force is given to sheet material 90 at contact point P by roller 83 so that sheet material 90 is curved. Due to stiffness by sheet material 90, the first reaction force functions. The above-mentioned reaction force by sheet material 90 presses roller 83 so that trailing section 902 of sheet material 90 is conveyed until a position (a prescribed position) where it is separated from roller 42 while the sheet material is reversed. In addition, in the second reversal area from the above-mentioned prescribed position of the above-mentioned sheet material to trailing section 902, sheet material 90 is curved due to its own weight with contact point Q as a fulcrum. The second reaction force due to stiffness by sheet material 90 presses roller 83 at contact point P. The sheet material is reversed due to the friction force by the roller so that the front surface and the rear surface of the sheet material are reversed.

The range of the degree of stiffness of the above-mentioned sheet material is 3–50 gf·cm. Stiffness of a sheet material is stiffness in accordance with a stiffness (Tabor) test method by means of JIS-P8125 (1994). If the upper limit of the range of the stiffness is exceeded, the stiffness of the sheet material becomes too great. Accordingly, great force is necessary to curve the sheet material. Reaction of the sheet material due to curving is too great so that coating property (uniform coating and coating unevenness) become deteriorated. If the lower limit of the range of the stiffness is exceeded, reaction of the sheet material due to curving is too small so that coating property become deteriorated. The range of the degree of stiffness of the sheet material is 4–30 gf·cm.

A sheet material referred to as here includes cut paper, plastic material, synthetic paper, ink jet printer printed material, cut film type image recording material and silver halide black-and-white paper.

In the invention a protective covering layer can be formed without losing glossiness and image texture which an image recording material inherently posses, by regulating coating amount A of the hydrophilic binder of an image recording material A ($g/m^2$) and the coating amount B of water coated concurrently with coating of an aqueous resin component ($g/m^2$) at $0.3 \leqq B/A \leqq 2.5$,. B/A is preferably $0.4 < B/A \leqq 2.0$ and more preferably $0.6 \leqq B/A \leqq 1.8$.

The coated amount of resin and the coated amount of water can arbitrarily be set by changing the density of the resin in an aqueous resin component and coated layer thickness. In order to know actually coated amount of resin and water, weight of sample before coating, immediately after coating and after drying, they can be calculated.

By adjusting appropriate B/A is value, preferable glossiness and image quality are resulted in.

In the present invention, in order to coat an aqueous resin component, it is preferable to use methods which can control coating amount such as a spray method, a roll coating method, a graveure coating method and a wire bar coating method. However, it is preferable not to use a dip coating method. If the dip coating method is used, it is difficult to control the above-mentioned B/A value. Specifically, if the above-mentioned component is coated on a color print in which gelatin is used as a binder, $B/A > 2.5$.

In order to form a protective layer of the present invention promptly and continuously, it is preferable to convey an image recording material using a roller. However, if the roller touches the surface of the protective layer immediately after the resin was coated, the protective layer becomes uneven and thereby reduction of glossiness and water resistance property is resulted in, causing deterioration of image texture. According to the present invention, time T (second) since the finish of coating the aqueous synthetic resin component until the roller touches the coating surface thereof can relatively be set shorter.

Pressing by means of the rollers while the coated layer is not completely dried after finish of coating the aqueous resin component is effective in terms of enhancing adhesivity between the protective covering layer and the gelatin layer. Therefore, if the above-mentioned time T is not so long, adhesivity between the protective covering layer and the gelatin layer does not become weak. Depending upon the conditions, the protective covering layer having strong properties against peeling off or scratching is resulted.

Preferable range of T is, in terms of the function of B/A, $B/A \times 1.5 \leqq T \leqq B/A \times 20$.

More preferably, $B/A \times 2 \leqq T < B/A \times 15$, and most preferably, $B/A \times 2.5 \leqq T \leqq B/A \times 10$.

Figure 6:
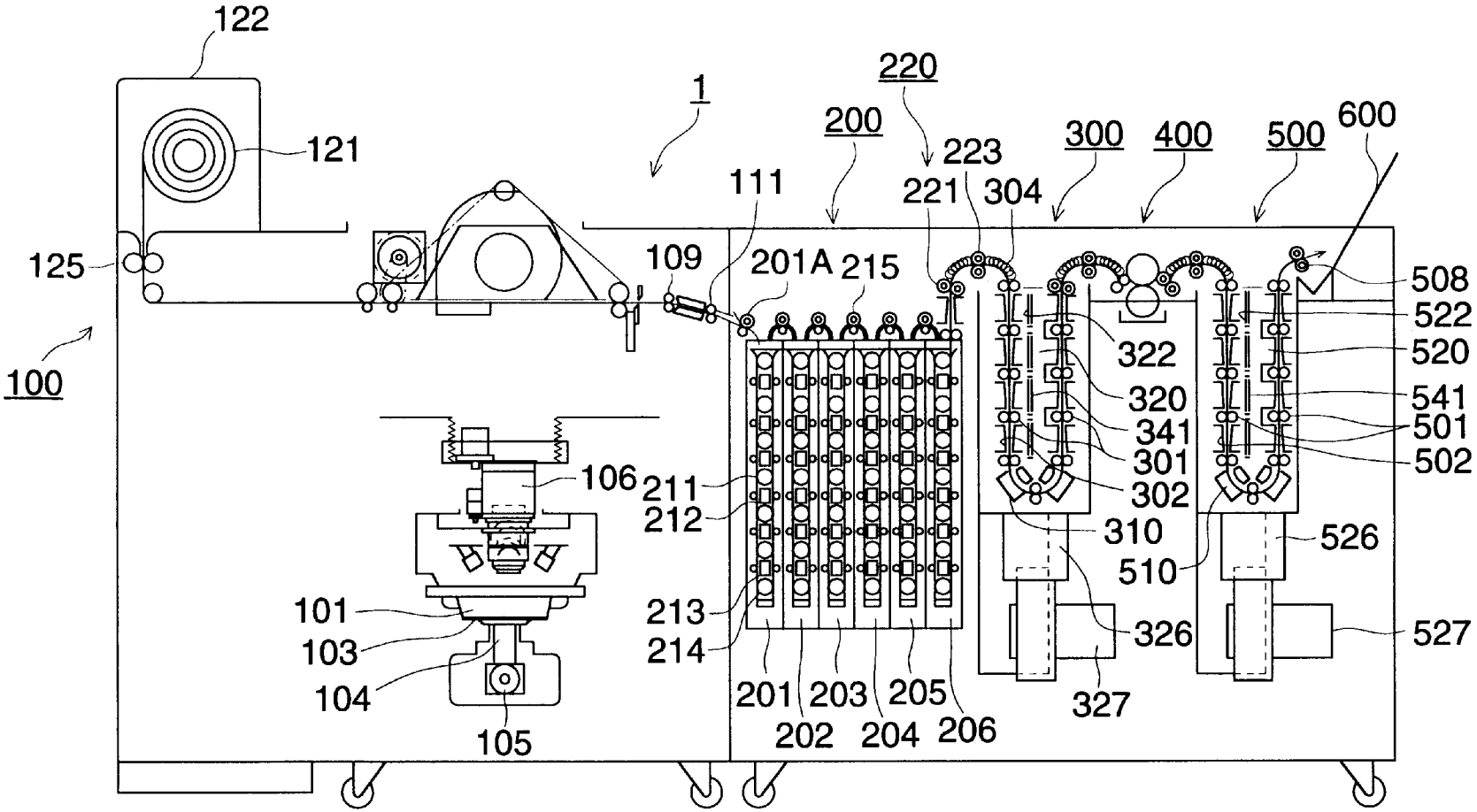
FIG. 6 illustrates a processing apparatus for forming a protective covering layer of the present invention on an image carrier layer.

FIG. 6 is a drawing showing another processing apparatus for forming the protective covering layer of the present invention on an image carrier layer.

Automatic developing machine (photographic processing machine) 1 of the embodiment is composed of printer section 100, photographic processing section 200, drier section 300 and coating section 500.

In printer section 100, photographic light-sensitive material 121 housed in magazine 122 loaded therein is fed out by means of sub-driver 125. When photographic light-sensitive material is sent to exposure position 108, negative film 103 sent to negative film loading stand 101 is subjected to image-sensing exposure by projection lens 106 while exposure lamp 105 is lit and the shutter (not illustrated) is operated. Photographic light-sensitive material 121 subjected to image exposure is conveyed to photographic processing section 200 through light-sensitive material sensing sensor 111 which senses passing of photographic light-sensitive material, paired roller 109 and inlet roller 201A.

In photographic processing section 200, in color developing tank 201, bleach-fixing tank 202 and stabilizing tanks 203 through 206, processing and conveyance guide plate 212 presses conveyance roller 211 by means of pressing member 213. Being sandwiched by them, photographic light-sensitive material 121 is slipped between guide plates to be conveyed due to driving of conveyance roller 121. Photographic light-sensitive material 121 is conveyed through each tank passing the lower conveyance U turn section 214 and the upper cross-over rack 215, and finally it is conveyed to drier section 300 by means of squeeze roller 221 of squeezing section 220, feeding roller 223 and inlet guide 304. The photographic paper subjected to photographic processing is fed into drier section 300 to be dried. Following this, the photographic paper is coated with a protective covering layer in coating section, and the protective covering layer is dried at drier section 500.

Drier section 300 of the embodiment can employ any existing drying methods. Typically, it is preferable to use a method to blow hot air for drying, a method utilizing an infrared rays and a method to contact to a heat roller. Specifically, hot air drying in which the surface property of the protective covering layer is preferable.

As shown in FIG. 1, photographic light-sensitive material 121 fed into drier section 300 is conveyed by each roller 301.

At the side of aforesaid each paired roller 301, plate type ceramic heater 341 is provided facing the emulsion surface of photographic light-sensitive material 121.

At upstream and downstream of each paired roller 301, light-sensitive material guide means 302 is respectively provided. Air blowing port 322 of air blowing means 320 is provided on the emulsion surface of photographic light-sensitive material closer to the heat irradiation surface of far-infrared irradiation means 341. Through the duct, air flow blows out to blow air flow on the emulsion surface of photographic light-sensitive material 121. Partially, air is blown onto the rear surface of photographic light-sensitive material.

At U turn section located on the lower portion, photographic light-sensitive material on which the emulsion coating surface is subjected to far-infrared irradiation, and air was blown including the rear surface U-turns safely by means of winding prevention guide 303. By means of each paired rollers 301 and light-sensitive material guide means 302, the photographic light-sensitive material starts conveying upward. In the meanwhile, on one side of light-sensitive material guide means 302, air blowing port 321 of air blowing means 320 is provided. Air blown therefrom is blown on the emulsion side and the rear side thereof. Photographic light-sensitive material is thus dried and is sent to coating section 400.

Far-infrared ray irradiating means 341 is located facingly the photographic light-sensitive material conveying path in such a manner that the irradiated far-infrared ray is directly irradiated.

As far-infrared ray irradiating means 341, a far-infrared ray lamp and nichrome wire style heater are cited. Among these, far-infrared ray ceramic heater as shown in Japanese Patent O.P.I. Publication is preferably used in terms of heat efficiency and handling property. The form thereof includes bar-shaped, cylindrical shape and plate shape. In terms of drying property, a heater having wider width compared with the maximum width of photographic light-sensitive material processed is preferably used. In drier section 300, plural number of far-infrared ray irradiation means 341 can be provided. Aforesaid means 341 may be provided on one side or on both sides in terms of the conveyance surface of photographic light-sensitive material conveyance means 301. In terms of drying heat efficiency, it is preferable that the amount of far-infrared ray irradiation on the emulsion surface of the photographic light-sensitive material is larger than that on the rear surface.

As air blowing means 320, a method to blow air at a gap between the photographic light-sensitive material emulsion surface and far-infrared ray irradiation means 341 as shown in Japanese Patent O.P.I. Publication No. 289296/1993 and a method in which air blowing port 322 of air blowing means in the vicinity of the photographic light-sensitive material conveyance surface compared with far-infrared ray irradiation means 341 are preferably used.

As conveyance roller 301, plural paired rollers facing each other and sandwiching the photographic light-sensitive material made of heat resistance resin material and rubber material used in Japanese Patent O.P.I. Publication No. 289296/1993. In terms of heat resistance property, chemical resistance property and storage stability, phenol resin, polyphenylene ether (polyphenylene oxide)-containing resin, fluorine-containing resin, polyphenylene sulfide resin, silicone rubber, ethylene polypropylene rubber and chloroplene rubber are specifically preferable materials for rollers.

In order to promote drying of photographic light-sensitive material wet with a processing solution, it is necessary to provide sufficient heat to the photographic light-sensitive material and it is also necessary to conduct moisture evaporation from the photographic light-sensitive material efficiently. By the use of far-infrared ray irradiation means 341, provision of heat to the photographic light-sensitive material is promoted effectively and thereby rapid drying becomes possible. However, the drying method utilizing far-infrared ray irradiation heat dries the photographic light-sensitive material at a short time. Therefore, it is difficult to control drying finishing condition. For example, over-drying is caused to give adverse influence on photographic performance. In addition, problems in conveyance system are caused due to curling of the photographic light-sensitive material. As aforesaid solving means, far-infrared ray irradiation means 341 is mainly used in the former half of drying section. For the purpose, air drying is used in combination and at the latter half of the drying section, air drying is conducted. Here, air blowing means 320 in which at least a part of air passed the former half of drying section is taken in by the latter half of drier section 300 is more meritable compared with far-infrared ray irradiation means 341 in terms of effectively utilizing far-infrared ray energy irradiated by far-infrared ray irradiation means 341. It is not necessary to install a heater separately for generating hot air. It is extremely meritable in terms of cost reduction and downsizing of the apparatus.

By maintaining the temperature of air in the former half of drying section in drier section 300 at 80–120° C., drying condition of the photographic light-sensitive material is continued so that uniform drying is conducted stably, realizing development finishing at high quality. When the temperature of air in the former half of the drying section is 80–120° C., defective drying or over-drying condition does not easily occurs.

It is preferable to feed back the measurement results of air temperature inside the former half of drier section for the control of the far-infrared ray irradiation means, and to control the far-infrared ray irradiation means in such a manner that air temperature be 80–120° C. when the light-sensitive material is subjected to drying suitably.

If the temperature of air in the former half of drying section is 40–80° C. during stand-by time for drying the light-sensitive material, light-sensitive material drying stand-by conditions is formed in which it is effective in terms of energy and rising of photographic light-sensitive material 121 to drying condition is rapid.

In photographic processing section, ambient air temperature is higher than the temperature of processing solution. Accordingly, if air fed by outside drying section is air introduced by photographic processing section 200 of photographic light-sensitive material automatic developing machine 1, it is preferable in terms of energy saving.

If air taking in port fed from outside the drier section is installed immediately before the air circulation means, air temperature of the air circulation means inlet port portion is reduced so that heat resistance temperature of the air circulation means can be reduced. As the air circulation means, air fan 327 and air duct 326 can be used. It is preferable to take structure of the drier section in which heat durability temperature of commercial fan cannot be exceeded.

As a coating section provided in the photographic processing apparatus of the present invention, any conventional coating apparatus can be used provided that coating amount of the protective covering layer dispersing solution can be controlled. As a conventional coating method, a spray coating method, a roller coating method, a graveure coating method, an air knife coating method, an extrusion coating method, a curtain coating method, a wire bar coating method and a method to coat with a solution oozed out from cloth or sponge-type material can be used.

Figure 7:
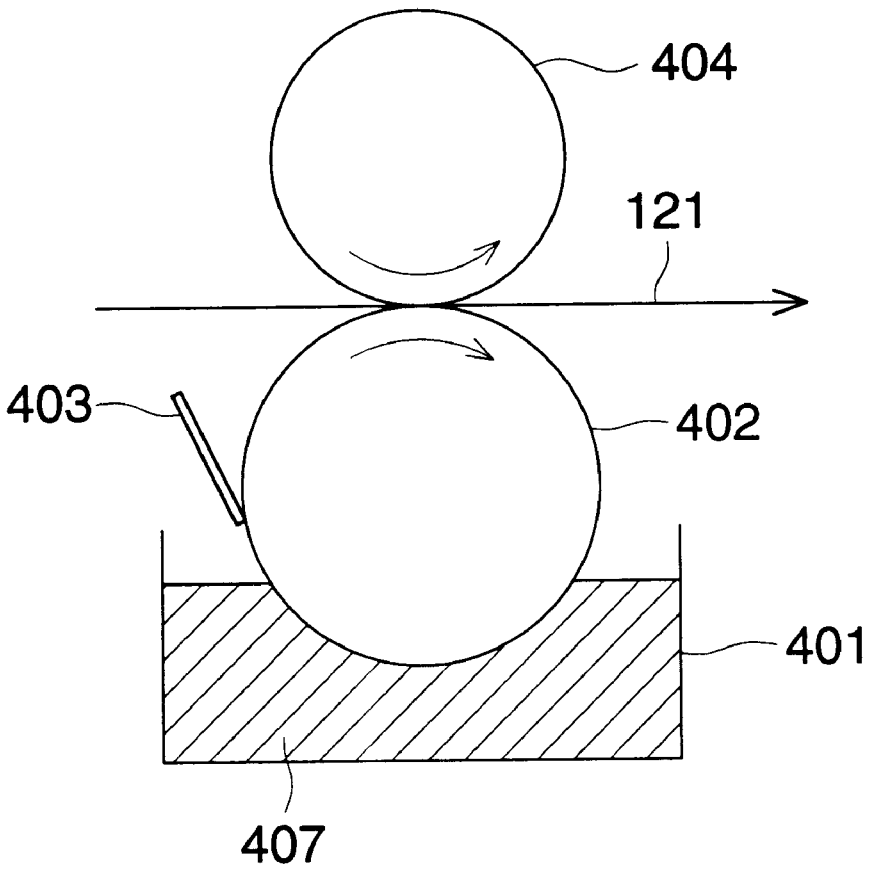
FIG. 7 illustrates a block diagram of a schematic constitution of a coating apparatus.

FIG. 7 is a drawing showing schematic constitution of the coating apparatus.

Coating section 400 is composed of pad 401 in which the protective covering layer solution is stored, coating roller 402, blade 403 and back roller 404. The protective covering layer solution is an aqueous resin solution. After excessive solution drawn up due to the rotation of coating roller 402 is scraped out, coating is conducted when photographic light- sensitive material 121 is caused to pass between coating roller 402 and back roller 404.

Incidentally, if a resin constituting the protective covering layer of the embodiment is aqueous, any of conventional resins can be used. However, considering water resistance property and the purpose of preventing fingerprints adhering, latex resins disclosed in Japanese Patent O.P.I. Publication No. 247370/1987, ionic polyester resins disclosed in Japanese Patent O.P.I. Publication No. 110169/1994, aqueous urethane resins and aqueous acrylic resin are cited. More preferably, aqueous polyurethane resins and aqueous acrylic resins respectively having high water resistance performance. In addition, as the above-mentioned preferable urethane resins commercially available, Super Flex series and Elastron series, produced by Dai-ichi Seiyaku Co., Ltd., Takerack W series and Takerack XW series containing a silanol group produced by Takeda Chemical Ind. Co., Ltd., HYDRAN series produced by Dai-Nippon Ink. Chemical Co, Ltd. are cited. As an aqueous acrylic resin, Brightone Series produced by Sakata Inks is cited.

"Aqueous resin" in the embodiment referred to as a resin using water as a solvent such as a water-soluble resin, aqueous emulsion and aqueous latex.

At the bottom of pad 401, a bar-shaped heater is located, and in the vicinity of coating roller 402, a temperature sensing sensor is provided. Temperature information obtained by aforesaid temperature sensor controls the heater by inputting the control section so that the protective covering layer solution is controlled at a prescribed temperature.

Coating roller 402 is a graveure roller (a grid type, precision roller produced by Asahi Roll Co., Ltd.) in which the surface thereof is sculptured and thereby the amount of drawing up of an aqueous resin can be controlled.

Backroller 404 is made of a silicone rubber for facilitating conveyance of photographic light-sensitive material 121. The shafts for coating roller 402 and back roller 404 is attached to the supporting section so as to be rotating. Bearing for coating roller 402 is fastened with a bis to be maintained.

Bearing for back roller 404 is maintained by a bis inserted to a slot on a supporting plate, in which one end of bearing is brought into contact with an adjust bolt and aforesaid adjust bolt is hinged with a blanket which is fixed on the supporting plate, crossing over the notch portion. The other end of the bearing is brought into contact with the pin on the adjusting lever. One end of this adjusting lever is supported on the supporting plate rotatably with a supporting pin as a fulcrum. The other end is brought into contact with the adjusting bolt through a brancket on the supporting plate. Gap between back roller 404 and coating roller 402 is set smaller than the thickness of photographic light-sensitive material 121 by loosing the bis which tighten the bearing for maintaining and actuating the adjusting bolt which positions vertically. For example, when the thickness of photographic light-sensitive material is 200 $\mu$m, it is preferable to set aforesaid gap at 100–180 $\mu$m, since the aqueous resin solution can uniformly be coated and aforesaid photographic light-sensitive material can smoothly be conveyed.

By forming blade 403 with Teflon or stainless steel and by bringing it into contact with coating roller 402 at an inclination angle of 45–75°, conveyance amount of the aqueous resin solution is controlled.

Pulley on coating roller 402 is connected with the pulley on the motor (not illustrated) through a belt. When coating roller 402 is rotated due to driving of motor, the motive force is transferred from the gear on coating roller 402 to the gear of back roller 404 to be rotated.

With regard to coating section 400, by providing the above-mentioned constitution, when the power supply switch is turned ON, the heater is actuated to be controlled at a set temperature. When the temperature is set at a set one, the motor is driven and coating roller 402 is rotated through the belt. Synchronized with it, back roller 404 is rotated. Due to rotation of coating roller 402, an aqueous resin solution is drawn up. At a prescribed layer thickness, the solution is carried on coating roller 402 to be conveyed. The thickness of the layer of an aqueous resin solution formed on coating roller 402 is dependent upon the viscosity of an aqueous resin and rotation rate of coating roller 402. Since coating roller 402 is brought into contact with blade 403, uniform and continuous processing of the aqueous resin is possible.

At coating section 400 of the embodiment, the added amount of resin when being dried may arbitrarily be set depending upon the purpose. Ordinarily, it is preferably, 0.1–10 g and 1–5 g per $m^2$.

In the same manner as in drier section 300, in drier section 500, any conventional drying method can be used. The drying temperature is preferably 120° C. or less due to the same reason as in drier section 300.

Incidentally, drier sections 400 and 500 of the embodiment may be added as a unit after conventional automatic photographic processing system drier section 300. Due to this, slight modification for an apparatus is accompanied. However, a conventional automatic photographic processing system can be used in an apparatus in the embodiment. Therefore, a conventional asset may be utilized.

Long roll photographic light-sensitive material 121 fed from magazine 122 is cut to a prescribed length by cutter 126 before reaching exposure position 108. Hereinafter, as a cut paper, aforesaid paper is processed in printer section 110, photographic processing section 200, drier section 300, coating section 400 and drier section 500. Finally, aforesaid paper is collected to collection port 600. Though it is not illustrated, a long roll photographic light-sensitive material is subjected to printer section 110, photographic processing section 200, drier section 300, coating section 400 and drier section 500, and then wind it. Following this, the photographic paper may be cut for each image.

Above is the schematic structure of photographic processing apparatus of the embodiment.

Next, coating processing of the protective covering layer in the photographic processing apparatus of the embodiment and its evaluation therefor will be explained.

Provided that moisture amount ($g/m^2$) contained in a hydrophilic binder on an image forming surface side on a photographic paper immediately after passing drier section 300 as B1 ($g/m^2$), coating amount of water coated simultaneously as B2 ($g/m^2$)an aqueous resin in coating apparatus 400 and added amount of aforesaid hydrophilic binder as A1 ($g/m^2$), coating is conducted for satisfying the following conditions.

$$(B1+B2)/A1<2.5$$

Due to this, as shown in Tables 3 to 6, the occurrence of the contamination on the roller is minimized so that a print photography having a protective covering layer having favorable surface property.

"Hydrophilic binder" referred to as here is defined to be natural polymers such as gelatin and polysaccharides and polymers having high water absorption property such as PVA and PEG. In the case of a photographic paper, mainly gelatin. When polysaccharides are used in combination with gelatin, polymers thereof are included.

Moisture amount B1 referred to as the embodiment is a relative value when the moisture content contained in aforesaid hydrophilic binder at temperature of 25° C. and humidity of 20%. Moisture content contained in a support and in a coating layer side on the rear side (BC side) is not contained.

Actually, for measuring B1, the weight of the photographic paper immediately after passing drier section 300 is quickly measured. Following this, from the weight after drying aforesaid photographic paper for 10 hours at 25° C. and 20%, the change of the weight of the support and the coating layer on BC side are subtracted to be calculated.

TABLE 3

| | Coating Solution | | | | | |
|---|---|---|---|---|---|---|
| Experiment No. | Al ($g/m^2$) | $B_1$ ($g/m^2$) | $B_2$ ($g/m^2$) | Coated Amount of Resin ($g/m^2$) | $B_1 + B_2$)/Al | Contamination on Roller |
| 1 | 7.7 | 0 | 21 | 2 | 2.7 | C |
| 2 | 7.7 | 0 | 19 | 2 | 2.5 | A |
| 3 | 7.7 | 0 | 17 | 2 | 2.2 | A |
| 4 | 7.7 | 0 | 12 | 2 | 1.6 | A |
| 5 | 7.7 | 0 | 8 | 2 | 1.0 | A |

Using an automatic photographic processing apparatus of the embodiment shown in FIG. 6, 1000 sheets in terms of a service size of print photograph provided with the protective covering layer was prepared.

On an image carrier layer of a photographic paper (Konica Color Type QA, produced by Konica) used then, 7.7 $g/m^2$ of gelatin was coated as a hydrophilic binder (namely, A1=7.7).

A solution for the protective covering layer is a polyurethane aqueous dispersed material Super Flex 410 produced by Dai-ichi Kogyo Seiyaku. By regulating the solid portion density of the coating solution and the line number of coating roller 402, the added amount of the protective covering layer was arranged to be 2 g per $m^2$. The amount of water B2 coated simultaneously with the resin in coating section 400 was 8–21 g per $m^2$.

In addition, drying conditions of drier section 300 was set B1 ($g/m^2$)=0.

Evaluation

Photographic paper was processed under conditions of Experiments No. 1–5, results of observing contamination by the protective covering layer resin adhered on conveyance rollers and conveyance guide in drier section 500 were exhibited.

A: No contamination due to resin occurred
C: There is contamination.

TABLE 4

| | Coating Solution | | | | | |
|---|---|---|---|---|---|---|
| Experiment No. | Al ($g/m^2$) | $B_1$ ($g/m^2$) | $B_2$ ($g/m^2$) | Coated Amount of Resin ($g/m^2$) | $B_1 + B_2$)/Al | Contamination on Roller |
| 6 | 7.7 | 1.0 | 21 | 2 | 2.9 | C |
| 7 | 7.7 | 1.0 | 19 | 2 | 2.6 | C |
| 8 | 7.7 | 1.0 | 17 | 2 | 2.3 | A |
| 9 | 7.7 | 1.0 | 12 | 2 | 1.7 | A |
| 10 | 7.7 | 1.0 | 8 | 2 | 1.2 | A |

Using an automatic photographic processing apparatus of the embodiment shown in FIG. 1, 1000 sheets in terms of a service size of print photograph provided with the protective covering layer was prepared.

On an image carrier layer of a photographic paper (Konica Color Type QA, produced by Konica) used then, 7.7 $g/m^2$ of gelatin was coated as a hydrophilic binder (namely, A1=7.7).

A solution for the protective covering layer is a polyurethane aqueous dispersed material Super Flex 410 produced by Dai-ichi Kogyo Seiyaku. By regulating the solid portion density of the coating solution and the line number of coating roller 402, the added amount of the protective covering layer was arranged to be 2 g per $m^2$. The amount of water B2 coated simultaneously with the resin in coating section 400 was 8–21 g per $m^2$.

In addition, drying conditions of drier section 300 was set B1 ($g/m^2$)=0.

Evaluation

Photographic paper was processed under conditions of Experiments No. 6–10, results of observing contamination by the protective covering layer resin adhered on conveyance rollers and conveyance guide in drier section 500 were exhibited.

A: No contamination due to resin occurred
C: There is contamination.

TABLE 5

| | Coating Solution | | | | | |
|---|---|---|---|---|---|---|
| Experiment No. | Al ($g/m^2$) | $B_1$ ($g/m^2$) | $B_2$ ($g/m^2$) | Coated Amount of Resin ($g/m^2$) | $B_1 + B_2$)/Al | Contamination on Roller |
| 11 | 6.5 | 0 | 21 | 2 | 3.2 | C |
| 12 | 6.5 | 0 | 19 | 2 | 2.9 | C |
| 13 | 6.5 | 0 | 17 | 2 | 2.6 | C |
| 14 | 6.5 | 0 | 12 | 2 | 1.8 | A |
| 15 | 6.5 | 0 | 8 | 2 | 1.2 | A |

In Experiment Nos. 11–15, the line number of coating roller 402 and the solid portion density of the protective covering layer solution was regulated in such a manner that added amount of the protective covering layer in the coating section in an automatic photographic processing system of the embodiment be 2 g per $m^2$and conditions were adjusted in such a manner that coated amount of water was as shown in Table 3, 1000 sheets of print photograph provided with the protective and covering layer were prepared in each condition. The protective covering layer solution used here was the same as in Table 1.

In addition, a photographic paper used here was the same as that used in Table 1 except that only the amount of hydrophilic binder of the photographic paper was reduced to 6.5 $g/m^2$.

In addition, drying conditions of drier section 300 was regulated to be B1 ($g/m^2$) be 0. Amount of water B2 coated together with the resin in coating section 400 was 8–21 g per $m^2$.

A photographic light-sensitive material was processed under each condition of the above-mentioned Example, and contamination due to the protective covering layer resin adhered on the conveyance roller and the conveyance guide of drier section 500 was observed. The above Table 5 shows the results thereof.

A: No contamination due to resin occurred

C: There is contamination.

TABLE 6

| | | Coating Solution | | | | |
|---|---|---|---|---|---|---|
| Experiment No. | Al ($g/m^2$) | $B_1$ ($g/m^2$) | $B_2$ ($g/m^2$) | Coated Amount of Resin ($g/m^2$) | $B_1 + B_2$)/A | Contamination on Roller |
| 16 | 6.5 | 4.6 | 21 | 2 | 3.9 | C |
| 17 | 6.5 | 4.6 | 19 | 2 | 3.6 | C |
| 18 | 6.5 | 4.6 | 17 | 2 | 3.3 | C |
| 19 | 6.5 | 4.6 | 12 | 2 | 2.6 | C |
| 20 | 6.5 | 4.6 | 8 | 2 | 1.9 | A |

In Experiment Nos. 16–20, the line number of coating roller 402 and the solid portion density of the protective covering layer solution was regulated in such a manner that added amount of the protective covering layer in the coating section in an automatic photographic processing system of the embodiment be 2 g per $m^2$and conditions were adjusted in such a manner that coated amount of water was as shown in Table 6, 1000 sheets of print photograph provided with the protective and covering layer were prepared in each condition. The protective covering layer solution used here was the same as in Table 1.

In addition, drying conditions of drier section 300 was regulated to be B1 ($g/m^2$) be 0. Amount of water B2 coated together with the resin in coating section 400 was 8–21 g per $m^2$.

A photographic light-sensitive material was processed under each condition of the above-mentioned Example, and contamination due to the protective covering layer resin adhered on the conveyance roller and the conveyance guide of drier section 500 was observed. The above Table 6 shows the results thereof.

A: No contamination due to resin occurred

C: There is contamination.

We claim:

1. An information recording material comprising a support having thereon an image carrier layer composed of at least one hydrophilic polymer and an outermost protective covering layer on said image carrier layer, wherein the protective covering layer contains an aqueous polyurethane resin which comprises a polycarbonate ester represented by the following Formula (I) as a monomer unit:

Formula (I)

wherein R represents a divalent combining group.

2. The information recording material as claimed in claim 1, wherein the protective covering layer contains a thermal reactive aqueous polyurethane resin or a thermoplastic aqueous polyurethane resin.

3. The information recording material as claimed in claim 1, wherein the aqueous polyurethane resin comprises an aliphatic isocyanate group and a carboxyl group as a monomer unit.

4. The information recording material as claimed in claim 1, wherein the protective covering layer contains a thermal active aqueous polyacryl resin or a thermoplastic aqueous polyacryl resin.

5. The information recording material of claim 1 wherein R is selected from the group consisting of aliphatic dioxane groups, aliphatic dioxy groups containing an aromatic group, and aromatic dioxane groups.

* * * * *